US012275444B2

(12) United States Patent
Dunn et al.

(10) Patent No.: US 12,275,444 B2
(45) Date of Patent: Apr. 15, 2025

(54) REMOTE RAIL MONITORING SYSTEM AND/OR METHOD

(71) Applicant: Parallel Systems, Inc., Los Angeles, CA (US)

(72) Inventors: Patrick Dunn, Los Angeles, CA (US); Casey Walker, Los Angeles, CA (US); Christopher E. Denniston, Los Angeles, CA (US); Vladi Iotov, Los Angeles, CA (US); Bobby Genalo, Los Angeles, CA (US); Benjamin Stuart Stabler, Los Angeles, CA (US); Julie Wang, Los Angeles, CA (US); Marc Greenbaum, Los Angeles, CA (US); Daniel Sweet, Los Angeles, CA (US)

(73) Assignee: Parallel Systems, Inc., Los Angeles, CA (US)

( * ) Notice: Subject to any disclaimer, the term of this patent is extended or adjusted under 35 U.S.C. 154(b) by 0 days.

(21) Appl. No.: 18/776,069

(22) Filed: Jul. 17, 2024

(65) Prior Publication Data

US 2025/0026388 A1 Jan. 23, 2025

Related U.S. Application Data

(60) Provisional application No. 63/527,186, filed on Jul. 17, 2023.

(51) Int. Cl.
*B61L 27/33* (2022.01)

(52) U.S. Cl.
CPC ..... *B61L 27/33* (2022.01); *B61L 2201/00* (2013.01)

(58) Field of Classification Search
CPC ..... B61L 27/33
See application file for complete search history.

(56) References Cited

U.S. PATENT DOCUMENTS 3,848,533 A 11/1974 Grow
11,305,796 B1 4/2022 Shue et al.
(Continued)

FOREIGN PATENT DOCUMENTS

CA 3074977 A1 10/2020
CN 102521868 A * 6/2012
(Continued)

OTHER PUBLICATIONS

Dunn, Patrick , et al., "Rail Authority System and/or Method", U.S. Appl. No. 18/373,225, filed Sep. 26, 2023.
(Continued)

*Primary Examiner* — Shelley Chen
(74) *Attorney, Agent, or Firm* — Jeffrey Schox; Diana Lin

(57) ABSTRACT

The system can include: a vehicle and a remote operator platform. The system can optionally include or be used with a motion planner and a set of remote data systems. However, the system can additionally or alternatively include any other suitable set of components. The system can function to facilitate remote monitoring of a vehicle system(s), such as an unmanned rail vehicle, and/or positive train control (PTC) when operating under speed-restriction rules. Additionally, the system can function to facilitate remote monitoring, tele-operation, and/or exception handling across multiple vehicles/trains by a single operator. Additionally, the system can function to adjust command of a remotely monitored vehicle based on the observability of the environment and/or response capability of a remote monitor/tele-operator (e.g., based on line-of-sight, video latency, etc.).

13 Claims, 12 Drawing Sheets

(56) References Cited

U.S. PATENT DOCUMENTS

| | | | |
|---|---|---|---|
| 2004/0006413 | A1 | 1/2004 | Kane et al. |
| 2004/0010432 | A1 | 1/2004 | Matheson et al. |
| 2007/0005200 | A1 | 1/2007 | Wills et al. |
| 2007/0150130 | A1 | 6/2007 | Welles et al. |
| 2009/0184211 | A1 | 7/2009 | Groves et al. |
| 2012/0203419 | A1 | 8/2012 | Tucker et al. |
| 2015/0008294 | A1 | 1/2015 | Desbordes et al. |
| 2015/0191186 | A1 | 7/2015 | Lucisano |
| 2016/0368495 | A1 | 12/2016 | Luther et al. |
| 2016/0375888 | A1 | 12/2016 | Allwardt |
| 2017/0108876 | A1 | 4/2017 | Mullan et al. |
| 2017/0320507 | A1 | 11/2017 | Denny et al. |
| 2018/0079436 | A1 | 3/2018 | Fifield |
| 2018/0231972 | A1 | 8/2018 | Woon et al. |
| 2018/0339719 | A1 | 11/2018 | Loughlin |
| 2019/0054929 | A1 | 2/2019 | Yao et al. |
| 2019/0176862 | A1 | 6/2019 | Kumar et al. |
| 2019/0281052 | A1 | 9/2019 | Lekkas |
| 2019/0389498 | A1 | 12/2019 | Grimm et al. |
| 2021/0094567 | A1 | 4/2021 | Imai et al. |
| 2021/0094597 | A1 | 4/2021 | Rush et al. |
| 2021/0132625 | A1 | 5/2021 | Gillett |
| 2021/0188332 | A1 | 6/2021 | Brooks et al. |
| 2021/0291883 | A1 | 9/2021 | Gotlund et al. |
| 2022/0137623 | A1 | 5/2022 | Goyal et al. |
| 2022/0185350 | A1 | 6/2022 | Kindt et al. |
| 2023/0063561 | A1 | 3/2023 | Nobileau |

FOREIGN PATENT DOCUMENTS

| | | | | | |
|---|---|---|---|---|---|
| CN | 103164750 | A | * | 6/2013 | |
| CN | 107948570 | A | * | 4/2018 | ..... H04N 21/440281 |
| CN | 111414518 | A | * | 7/2020 | ..... G01C 21/005 |
| CN | 111652935 | A | * | 9/2020 | ..... G06T 5/002 |
| CN | 110758477 | B | * | 11/2021 | ..... B61L 25/025 |
| CN | 114067290 | A | * | 2/2022 | |
| CN | 116664388 | A | * | 8/2023 | |
| CN | 112613509 | B | * | 7/2024 | ..... G06F 18/241 |
| JP | 6851278 | B2 | | 3/2021 | |
| WO | 2017211593 | A1 | | 12/2017 | |
| WO | 2018026615 | A1 | | 2/2018 | |
| WO | 2018054616 | A1 | | 3/2018 | |
| WO | 2022192795 | A2 | | 9/2022 | |
| WO | 2022263144 | A1 | | 12/2022 | |

OTHER PUBLICATIONS

Dunn, Patrick , et al., "Rail Control System and/or Method", U.S. Appl. No. 18/499,034, filed Oct. 31, 2023.

Dunn, Patrick , et al., "Remote Rail Monitoring System and/or Method", U.S. Appl. No. 18/776,069, filed Jul. 17, 2024.

Dunn, Patrick , et al., "System and/or Method for Remote Operation of a Rail Vehicle", U.S. Appl. No. 18/514,946, filed Nov. 20, 2023.

Fraga-Lamas, Paula , et al., "Towards the Internet of Smart Trains: A Review on Industrial IoT Connected Railways", Sensors, Jun. 21, 2017, URL: https://www.mdpi.com/1424-8220/17/6/1457.

Greenbaum, Marc , et al., "Railway Switch Management System and/or Method", U.S. Appl. No. 18/672,864, filed May 23, 2024.

Pendleton, Scott Drew, et al., "Perception, Planning, Control, and Coordination for Autonomous Vehicles", Google Scholar, M DPI Machines, Feb. 2017, pp. 1-54. (Year: 2017).

Sanaei , et al., "Interface for a Railway Control System", Chalmers University of Technology, Dec. 13, 2011, <URL: http://odr.chalmers.se/bitstreams/fcb1915c-254a-4c15-b364 66d99a4c2167/download>.

Singh, Prashant , "Deployment of Autonomous Trains in Rail Transportation: Current Trends and Existing Challenges", Google Scholar , IEEE Access, vol. 9, Jun. 2021, pp. 91427-91461. (Year: 2021).

* cited by examiner

REMOTE RAIL MONITORING SYSTEM AND/OR METHOD

CROSS REFERENCE TO RELATED APPLICATIONS

This application claims the benefit of U.S. Provisional Application No. 63/527,186, filed 17 Jul. 2023, which is incorporated herein in its entirety by this reference.

This application is related to U.S. application Ser. No. 18/514,946, filed 20 Nov. 2023, which claims the benefit of U.S. Provisional Application No. 63/426,552, filed 18 Nov. 2022, each of which is incorporated herein in its entirety by this reference.

TECHNICAL FIELD

This invention relates generally to the transportation field, and more specifically to a new and useful rail monitoring system and/or method in the transportation field.

DESCRIPTION OF THE PREFERRED EMBODIMENTS

Figure 1:
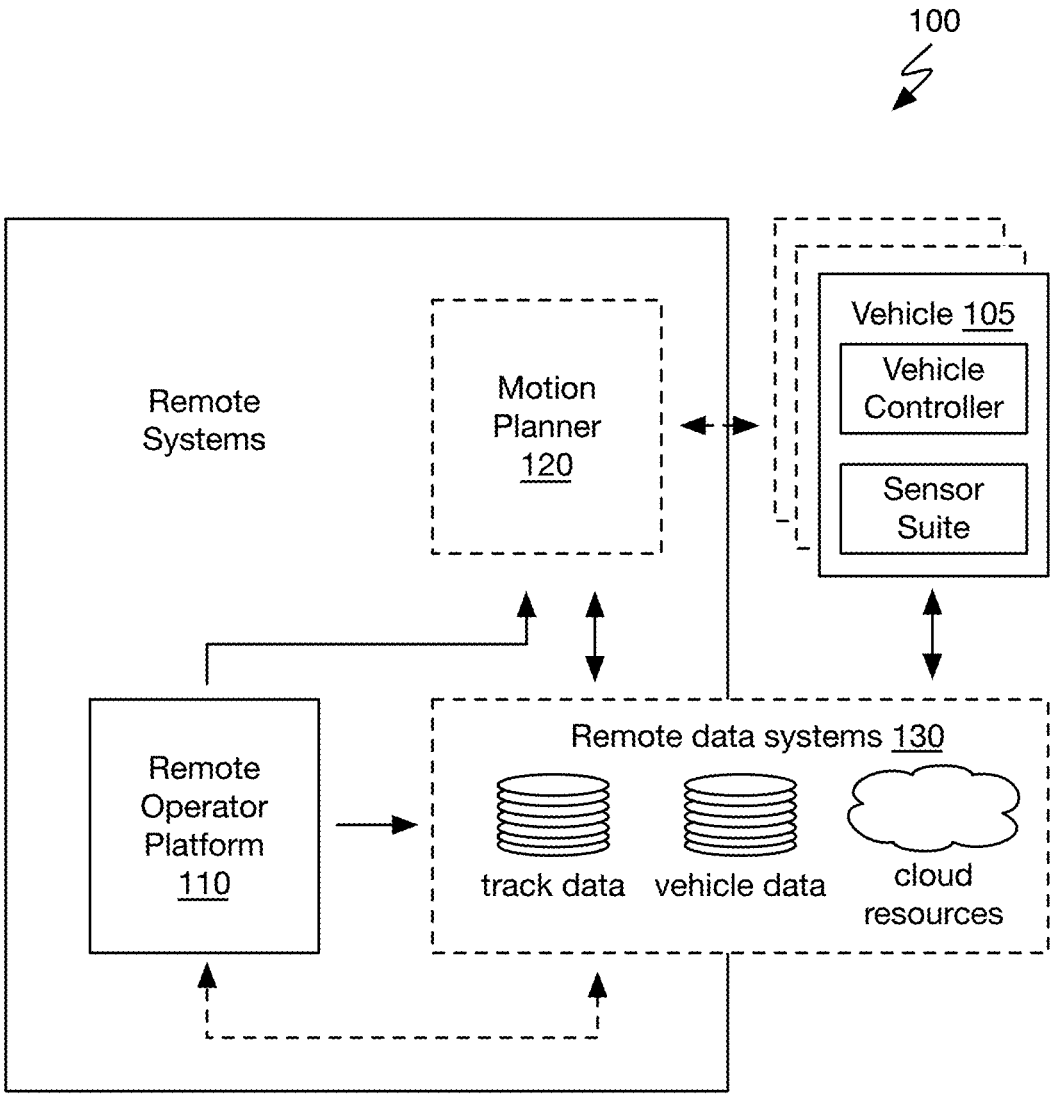
FIG. 1 is a schematic representation of a variant of the system.

The following description of the preferred embodiments of the invention is not intended to limit the invention to these preferred embodiments, but rather to enable any person skilled in the art to make and use this invention.

1. Overview

The system 100 can include: a vehicle and a remote operator platform. The system can optionally include or be used with a motion planner and a set of remote data systems. However, the system 100 can additionally or alternatively include any other suitable set of components. The system functions to facilitate remote monitoring of a vehicle system(s), such as an unmanned rail vehicle, and/or positive train control (PTC) when operating under speed-restriction rules. Additionally, the system can function to facilitate remote monitoring, tele-operation, and/or exception handling across multiple vehicles/trains by a single operator. Additionally, the system can function to adjust command of a remotely monitored vehicle based on the observability of the environment and/or response capability of a remote monitor/tele-operator (e.g., based on line-of-sight, video latency, etc.).

In variants, the system can facilitate a single operator (e.g., remote tele-operator) supervising a multitude of vehicles within a regional area, rail network, and/or which may be routed to move through the same set of switches. For example, the system can operate in conjunction with the tele-operation system(s) (and/or prioritization scheme [s]) as described in U.S. application Ser. No. 18/514,946, filed 20 Nov. 2023, titled "SYSTEM AND/OR METHOD FOR REMOTE OPERATION OF A RAIL VEHICLE," which is incorporated herein in its entirety by this reference.

The system can optionally include or be used in conjunction with a vehicle(s) which can traverse within a rail network according to the motion plan and/or commands associated therewith. Each vehicle(s) can include a vehicle controller and/or any other suitable elements. However, the vehicle can include any other suitable elements and/or can be otherwise configured.

In variants, the vehicle(s) can be as described in one or more of: U.S. application Ser. No. 17/694,499, filed 14 Mar. 2022, titled "ELECTRIC RAIL VEHICLE," U.S. application Ser. No. 17/335,732, filed 1 Jun. 2021, titled "ELECTRIC RAIL VEHICLE," each of which is incorporated herein in its entirety by this reference. In variants, the vehicle controller can facilitate vehicle control and/or platooning in accordance with the system and/or methods as described in U.S. application Ser. No. 17/732,143, filed 28 Apr. 2022, which is incorporated herein in its entirety by this reference. In a specific example, the vehicle controller can be the controller of a leading vehicle of a leading car of a platoon (e.g., wherein a remainder of vehicles and/or cars of the platoon are controlled based on the operation of the leading car).

In variants, the system can include or operate in conjunction with the switch management system(s) (and/or wayside asset management system) as described in U.S. application Ser. No. 18/672,864, filed 23 May 2024, which is incorporated herein in its entirety by this reference. For instance, the remote operator platform can facilitate remote assistance of vehicles and/or remote monitoring of switches based on vehicle sensor data (e.g., as may be required in some cases to allow the vehicle to proceed through an unmonitored switch/junction).

The term "switch" as referenced herein preferably refers to a railroad switch (a.k.a., turnout), which can be used to guide railway vehicles from one track to another. For example, railway switches can include slip switches (e.g., single slip, double slip, outside slip, etc.), crossovers, stub switches, three-way switches, plate switches, interlaced turnouts, off-railers, wye switches, run-off points, rack switches, switch diamonds, single point switches, rotary switches, temporary points, and/or any other suitable switch(es). Switch states can be binary (e.g., main-to-main or turnout/siding) or nonbinary (e.g., multi-state; 3 states for a three-way switch; where 'unknown' may add an additional state for an otherwise-binary switch state; etc.). Additionally, the term "switch" may refer to a wayside asset and/or rail feature with multiple states (i.e., where the state may 'switch'), such as a signal, junction, crossing, switch, and/or any other suitable wayside asset associated with the track. In such variants, it is understood that the term "switch management system" may be interchangeable with the term "infrastructure management system," "wayside asset management system," or the like, and/or may be otherwise suitably used or referenced. However, the term "switch" can be otherwise suitably used or referenced herein.

Switches and/or wayside assets can include: unmonitored systems, monitored systems (e.g., monitored switch; monitored by a track monitoring system [s]; etc.), manually adjustable/actuatable systems (e.g., locally; manual railroad switch), remotely actuatable/controllable systems (e.g., by a UI, etc.), and/or any other suitable type(s) of wayside assets.

The term "track rules" as utilized herein preferably refers to rules imposed on a track by a regulatory authority (e.g., FRA), but can additionally or alternatively refer to general operating rules (e.g., GCOR), railroad system special instructions, railroad operating rules, a subdivision timetable, operator, other regulatory rules, and/or any other suitable set(s) of rules. For example, track rules may dictate that a train cannot exceed 20 miles per hour at restricted speed, while the operating rules (e.g., provided by an operation company or a higher authority) might state the vehicle is only authorized to travel 15 miles per hour within that section of track. The operating rules of train operating companies may be a superset of the minimum rules outlined in GCOR. Accordingly, the term track rules as utilized herein may be interchangeably referenced with operating rules, specifically refer to railroad authority rules, and/or otherwise suitably refer to any combination(s)/permutation(s) of train rules for a particular track, which can include any safety rules, regulations, and/or operational restrictions which may be permanent, temporary, and/or situational, and may be promulgated by a regulatory body (e.g., CFR promulgated by FRA), a coalition of railroads (e.g., GCOR or MSRP), or the host railroad (e.g., railroad and its timetable). However, the term track rules may be otherwise suitably used/referenced herein.

The term "substantially" as utilized herein can mean: exactly, approximately, within a predetermined threshold or tolerance (e.g., 0.1%, 1%, 5%, 10%, 50%, etc.), and/or have any other suitable meaning.

1.1 Illustrative Example

Figure 4:
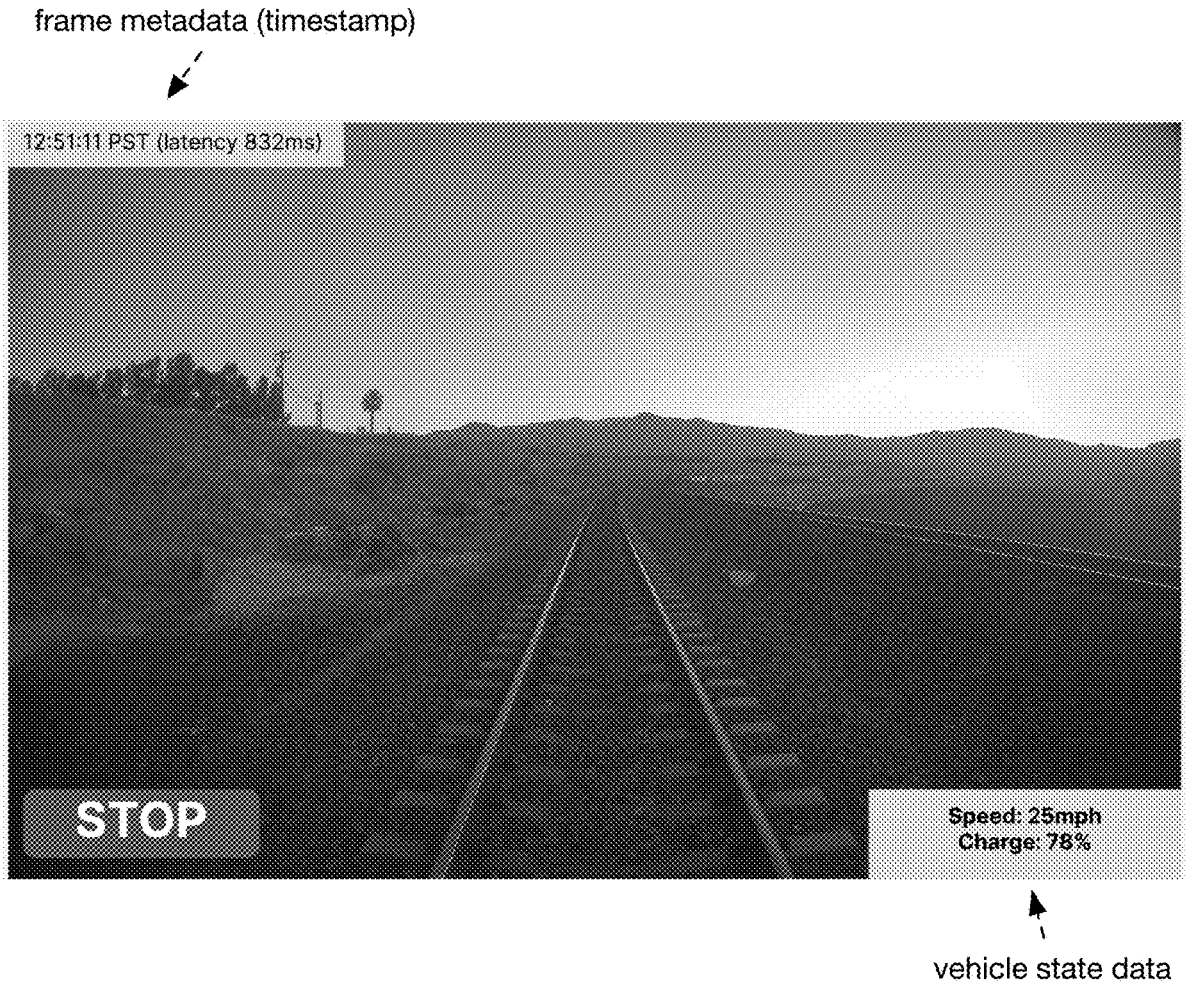
FIG. 4 is an example of a display interface in one or more variants of the remote operator platform.
Figure 5:
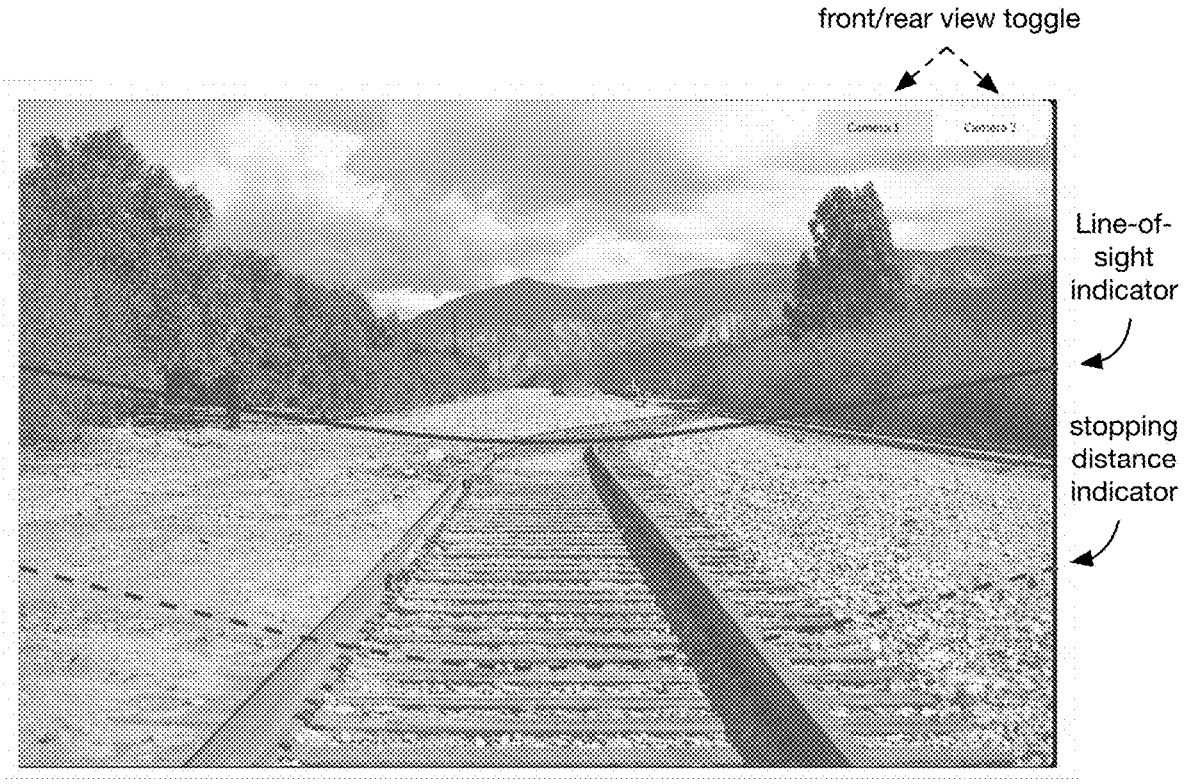
FIG. 5 is an example of a display interface in one or more variants of the remote operator platform, which illustrates an example line-of-sight indicator and an example stopping distance indicator.
Figure 6:
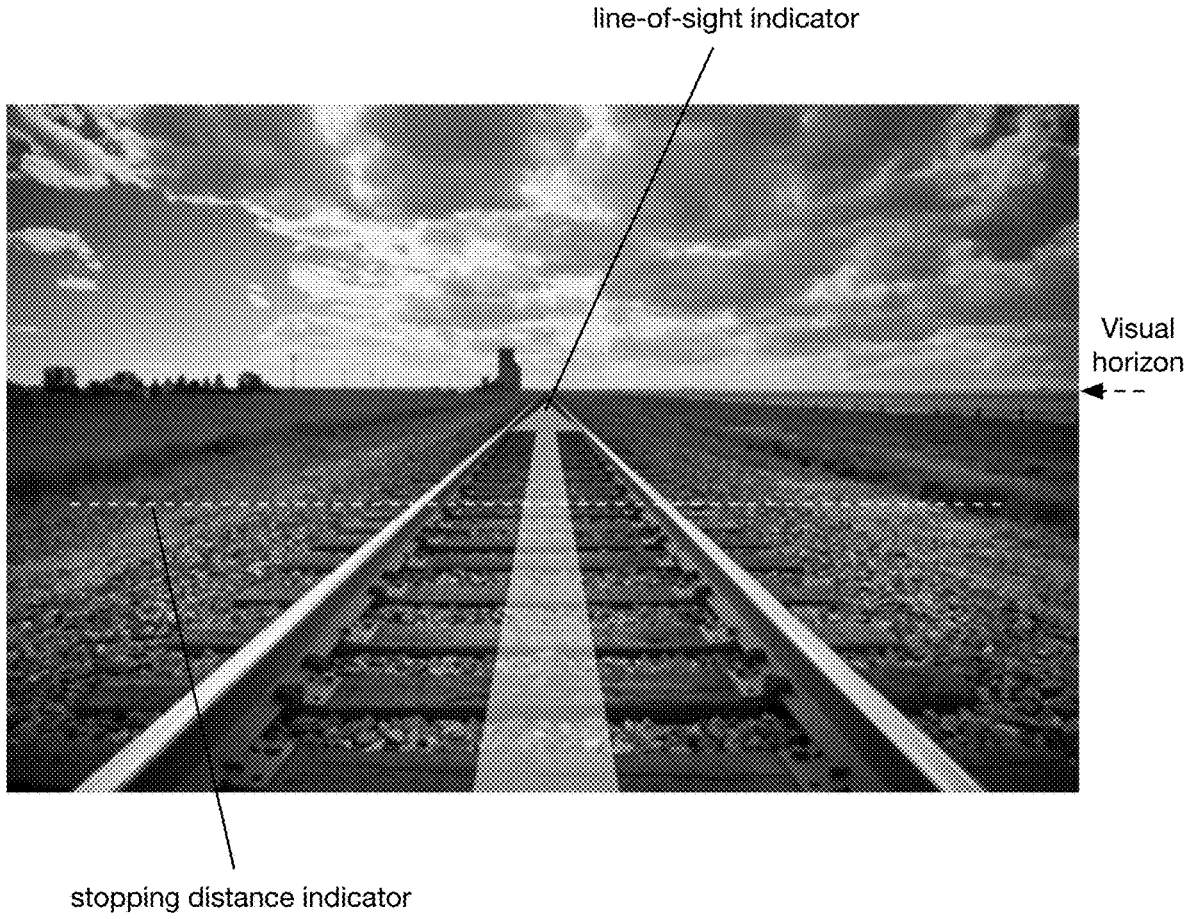
FIG. 6 is an example of a display interface in one or more variants of the remote operator platform, which illustrates an example line-of-sight indicator and an example stopping distance indicator.

In variants, the system can include an autonomous rail vehicle, which is directed within a rail network by a motion planner (e.g., configured to provide positive train control; commands may be issued at regular intervals, such as every 1-10 seconds). The autonomous rail vehicle can collect sensor data and autonomously operate (e.g., provide high-frequency, granular powertrain/braking control, closed loop motion control, etc.) based on commands periodically issued by the motion planner. Additionally, the autonomous rail vehicle can transmit sensor data and/or video feeds thereof (e.g., via an IP streaming protocol, such as LL-HLS, RTSP, WebRTC, etc.) to a remote operator platform, which can allow human monitoring of the vehicle. As an example, a remote human monitor(s) interfacing with the remote operator platform may provide command verification (e.g., at a switch junction), grant proceed authority (e.g., within a speed restricted region of track), and/or issue new commands (e.g., in a rail yard context) to facilitate operation of the autonomous vehicle under various track rules and/or in various operational contexts. At the remote operator platform, a remote operator can identify and/or grant proceed authority within an observable region of track (e.g., which may be highly variable under various lighting conditions, track curvature, etc.; examples are shown in FIGS. 4-6; based on operator line-of-sight for the video feed and/or individual frames thereof). In one example, proceed authorization and/or commands can be provided for a distance along the track and/or temporal window (e.g., based on the sampling position/time of the image), which may provide resilience to high-latency video signals and/or command transmission (e.g., rural/remote tracks where cellular network coverage is poor may commonly have 1 second latency; an example is shown in FIG. 4).

2. Benefits

Variations of the technology can afford several benefits and/or advantages.

First, variations of this technology can facilitate remote monitoring of autonomous rail vehicles within 'restricted speed' and/or 'monitored' regions of track, in compliance with a variety of track rules. For example, track rules and/or vehicle rules may dictate that a rail vehicle must be able to stop within operator 'line-of-sight' (or half line-of-sight, where potential exists for two vehicles to approach in opposite directions). Accordingly, variants can facilitate remote supervision and/or command validation based on the line-of-sight of a remote operator (e.g., commands and/or proceed authorization may be granted based on the region of track the operator reports as being observable and/or based on the time of observation), where the visual horizon and/or observable line-of-sight distance relative to the visual horizon may dictate how far the vehicle may safely proceed under supervision of the remote operator.

Second, variations of this technology can facilitate positive train control (PTC) in conjunction with a remote teleoperator/user issuing commands, while remaining resilient to varying signal latency and/or signal integrity. For example, variants may be configured to operate in conjunction with input latency, video transmission latency, command signal latency, and/or any other suitable sources of latency or communication failures which may be factored into PTC relative to the effective line-of-sight and/or operator response time.

Third, variations of this technology can improve the integrity of remote monitoring with various forms of validation/verification (e.g., passive validation of hardware and/or hardware operability, passive verification of user-attention, active user attention monitoring, etc.).

Fourth, variations of this technology can facilitate remote command of an independent perception-in-the-loop autonomy system(s).

However, variations of the technology can additionally or alternately provide any other suitable benefits and/or advantages.

3. System

The system 100, an example of which is shown in FIG. 1, can include: a vehicle 105 and a remote operator platform 110. The system can optionally include or be used with a motion planner 120 and a set of remote data systems 120. However, the system 100 can additionally or alternatively include any other suitable set of components. The system functions to facilitate remote monitoring of a vehicle system(s), such as an unmanned rail vehicle, and/or positive train control (PTC) when operating under speed-restriction rules. Additionally, the system can function to facilitate remote monitoring, tele-operation, and/or exception handling across multiple vehicles/trains by a single operator. Additionally, the system can function to adjust command of a remotely monitored vehicle based on the observability of the environment and/or response capability of a remote monitor/tele-operator (e.g., based on line-of-sight, video latency, etc.).

3.1 User Interface

Figure 3:
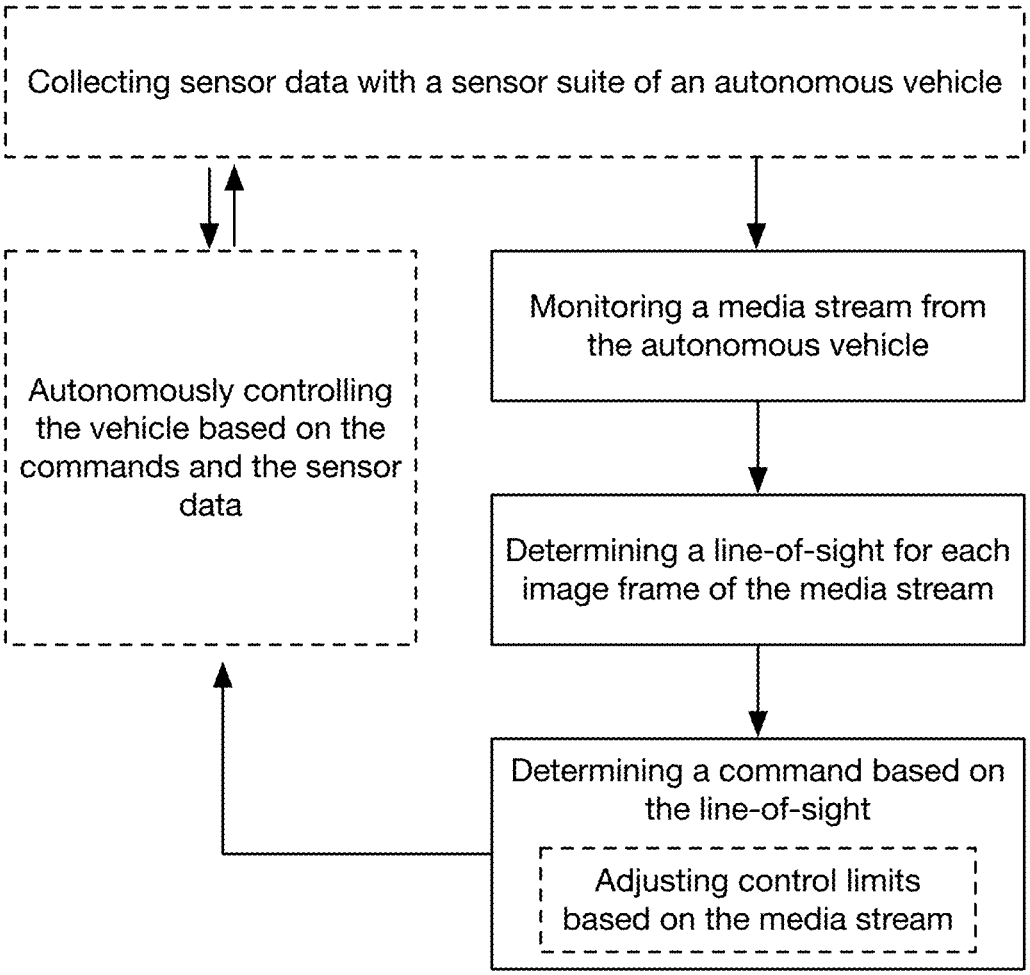
FIG. 3 is a flowchart diagram of a variant of the method.

The user interface [UI] functions to facilitate manual vehicle routing and/or instruction/command of vehicles (e.g., in a yard operations context). Additionally or alternatively, the user interface can function to facilitate tele-operation (e.g., in a restricted speed context), manual updates to track map data (e.g., manual determinations of switch state for unmonitored switches, etc.), manual exception handling, manual operation of track infrastructure (i.e., manual switch state changes and/or state inputs), and/or other manual interventions/inputs. The user interface can be communicatively connected to the motion planner system, the track data system/service, the switch management system, and/or any other suitable data endpoints to provide manual navigation/routing instructions to facilitate for vehicle command, dispatch, and/or control. Additionally, user inputs via the user interface can be used to update the track data (e.g., based on manual bulletin inputs, manual switch state inputs, etc.; within the track data system and/or a map service thereof). In a specific example, user input provisions via the UI can be used by the switch management system to maintain a persistent belief state for the switches within the rail network. Additionally, the UI can surface feedback to a user(s) based on data aggregated from other systems/endpoints of the system (e.g., an example is shown in FIG. 3). The UI can surface feedback which can include: aggregated track data (e.g., managed by map service), vehicle routes (e.g., determined by manual routing and/or a fleet management system) track reservations (e.g., governed by motion planner), switch reservations (e.g., governed by the switch management system), vehicle state data (e.g., based on data received from vehicle controller), switch state data (e.g., determined by the switch management system), map service data (e.g., track map, state data, track rules, bulletins, feature waypoints, etc.; an example is shown in FIG. 3), and/or any other suitable data.

Figure 2:
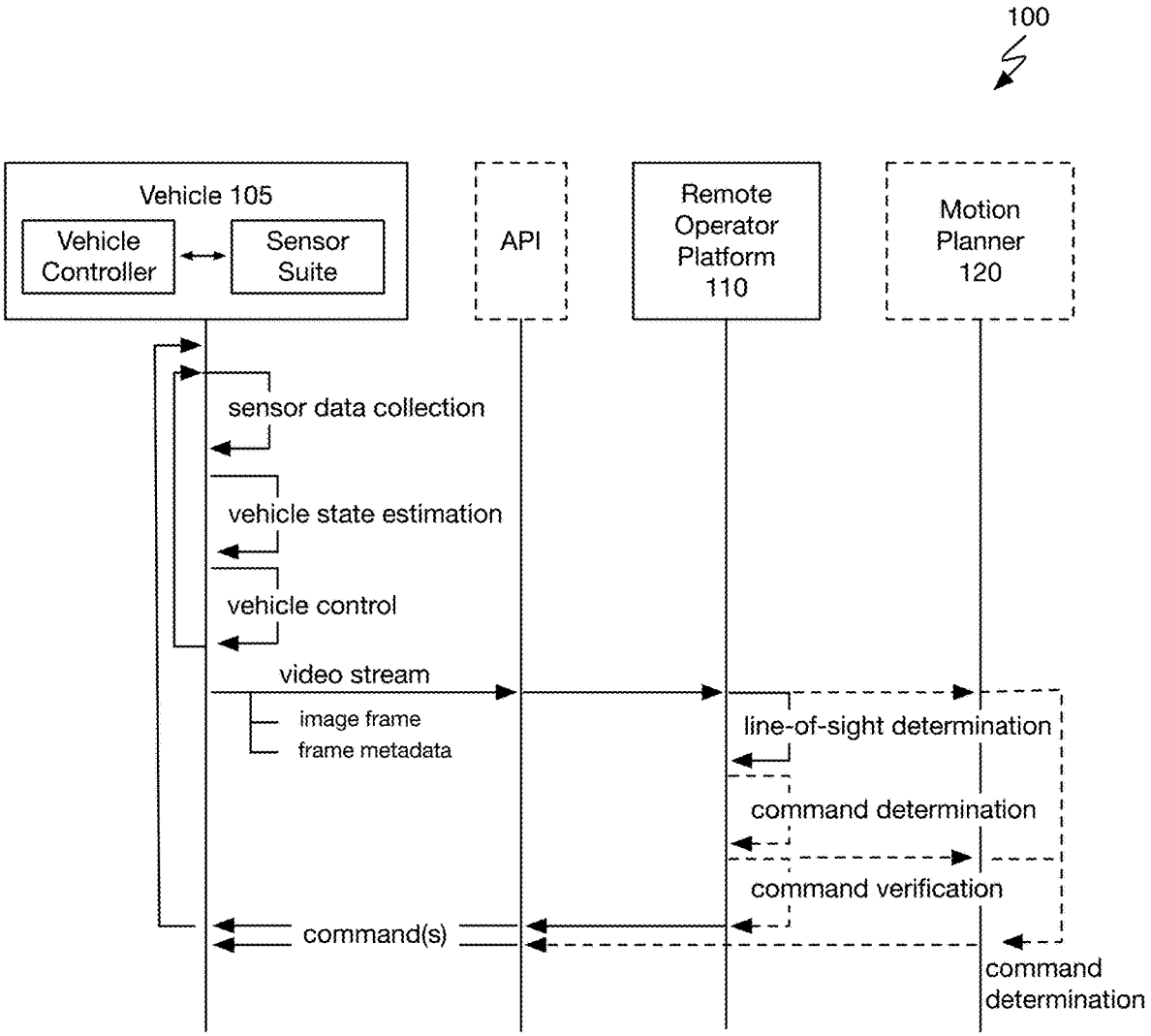
FIG. 2 is a schematic representation of a variant of the system.

In some variants, such as in a yard operation context, user inputs received via the UI can be used to generate vehicle routing instructions (e.g., an example is shown in FIG. 2) and/or (navigation) commands, which can be used to indirectly control a vehicle(s). For example, users can provide waypoints-based routing commands to the motion planner (e.g., via an API), which can be used to control the vehicle(s) in by the system(s) and/or method(s) as described in U.S. application Ser. No. 18/499,034 filed 31 Oct. 2023, titled "RAIL CONTROL SYSTEM AND/OR METHOD," which is incorporated herein in its entirety by this reference. In variants, the UI may facilitate manual provisions of waypoint-based commands via selection of waypoints (e.g., automatically generated waypoints) in an overlayed satellite image, aerial image, GPS referenced map, and/or another suitable interface. For instance, the UI may facilitate waypoint selection via a web application, API, mobile device (e.g., tablet or other wireless/cellular device), and/or any other suitable device(s)/service(s). In a first example, a yard operator (e.g., in proximity to a train/vehicle) may select predetermined waypoints (e.g., associated with predefined track features; automatically generated from named/mapped track features) via a first device which is communicatively coupled (e.g., wirelessly, by data aggregation service) to the motion planner, such as via a web app and/or API. As a second example, a remote operator may select waypoints via a remote (tele-) operator platform. As a third example, users may select automatically generated waypoints for named track features based on a (semantic) track feature name (e.g., or other index/ID), allowing the user to select the (predefined) geocoordinate waypoint (e.g., without needing to directly input specific coordinates). For instance, a user may select semantic names for a series of switches (and/or clearance points, switch legs, junctions, etc.) to manually generate and assign a route for a particular vehicle. As a fourth example, users may select waypoints to route a vehicle through a series of indexed track switches. However, the UI may otherwise facilitate selection/provision of waypoints. The waypoints can be separately maintained in a waypoint database, managed as a part of the track data service, generated using data from an external database(s) (e.g., a satellite map of Earth; a railroad authority map; etc.), and/or can be otherwise determined. In a first variant, waypoints can be predetermined and/or automatically determined based on the locations of track features. Alternatively, the UI may be used to manually define waypoints (e.g., relative to an aerial image, etc.), and/or may define positions/distances relative to waypoints (or associated track features).

The user interface can be used to determine and/or validate switch states (a.k.a., switch positions) to enable vehicle movement in conjunction with vehicle routing and train control. Additionally, the user interface can direct manual actions to change the state of a switch (e.g., based on existing vehicle routes and/or track rules). For example, users can be notified via the UI of a train approaching a switch (e.g., notification triggered based on the vehicle state, such as when the vehicle is about 0.25 miles away from the switch clearance point or about 1 minute away given the current motion plan), and request that the user modify the switch state (e.g., change configuration from default to route the vehicle to a siding). The user can manually change the switch position and provides confirmation of the switch state change via the UI (e.g., the switch management system can then update the belief state of the switch and reserve the switch to restrict automated/manual modification of the state). Once the train has cleared the switch and a distal switch clearance point (and the reservation of the switch has been released by the switch management system), the user may be notified and/or the switch state may be modified by the user. For instance, the UI may direct the user to modify the switch state to a new target state. Additionally or alternatively, the user may return the switch to a default state, such as lining the switch main-to-main (e.g., which may be required by track rules), once the reservation(s) on the switch are released.

However, the system can include or be used with any other suitable user interface and/or can exclude a user interface.

3.2 Track Data

The system can include or be used with a track data system which functions to store and/or maintain track data to be used for routing, dispatch, and/or vehicle control. The track data maintained within the track data system can include: a waypoint database; a track geometry (e.g., including a map of track segments, each including an 'edge' extending between a pair of 'nodes'; versioned, such as with an instance identifier and/or timestamp associated with the most recent update; etc.), track features (e.g., track geometry, clearance points, grade crossings, switch states, signal states, bulletins locations, etc.), track conditions (e.g., work zones, SR/RS zones, etc.), and/or any other suitable track data. In an example, the track geometry can be defined by a set of named track features (e.g., mileposts, fractional mileposts, control points, clearance points, signals, switches, stations, terminal locations, crane locations, charger locations, garages, destinations of interest, features/coordinates associated with track rules, etc.), each associated with a geographic location (or 'node'), with track segments defined therebetween, along a linear 'edge' or path between the nodes. The track geometry can be represented as a graph (e.g., of locations/nodes connected by track segments), a map, and/or otherwise represented. The track geometry and/or track data can be predetermined, derived from 3$^{rd}$ party data/maps (e.g., railroad maps), received from a railroad authority, and/or can be otherwise determined/updated with any suitable timing/frequency. The motion planner and the vehicle controller can both access and/or locally store track data (e.g., versioned track geometry) for use in any suitable determination/control. Track data can be pushed to the motion planner and/or vehicle controller(s) and/or pulled from the track data system (e.g., by the motion planner and/or vehicle controller) with any suitable timing/frequency. In a specific example, track data pertaining to regions proximal to the vehicle (e.g., within an authority granting region; within a 50-mile radius; a rail yard map at a current location or at a planned destination; etc.) can be pushed to the vehicle controller with any suitable timing/frequency (e.g., as a part of a warrant provision and/or as a part of command provision; separately from provision of commands or authority grants/warrants; etc.). However, the system can otherwise operate with any other suitable track data system and/or track map(s), and/or can otherwise maintain track data knowledge/information sharing throughout the system.

In variants, waypoints (and/or waypoint database) and/or track features (e.g., switches and/or switch states associated therewith) can be entirely independent of the track geometry. For example, track features and/or waypoints associated therewith can be managed in an external database or map service (e.g., tagged locations in a satellite map of Earth, for example) which can be used to generate GPS references for user-selected waypoints. Alternatively, the waypoints can be maintained locally (e.g., managed in a local database using proprietary data collected and/or stored by a server), remotely, via cloud storage/processing, generated (algorithmically) during runtime (e.g., around proximal track features), and/or can be otherwise maintained/managed. Waypoints can be associated with track features (i.e., at least a portion of the waypoints may be associated with and/or defined relative to the Earth-relative position of a track feature), which can include: mileposts, fractional mileposts, control points, clearance points, signals, switches, stations, terminal locations, crane locations, charger locations, garage locations, destinations of interest, and/or any other suitable track features/coordinates associated with track rules. Waypoints can be defined with a GPS/GNSS coordinate position, an Earth-referenced cell (e.g., S2 cells, etc.), a geohash, and/or can be otherwise suitably defined. In variants, waypoints can be automatically generated from (i.e., defined based on the locations of) mapped track features (e.g., from a map service, external database, or separately managed database). As an example, waypoints can be automatically generated from track features in a map, which may allow users to select waypoints relative to (pre-) mapped track features without manually entering a coordinate position for the feature. Waypoints can be automatically generated from mapped track features during runtime (e.g., pulled from a database or map service in proximity to a relevant portion of track, allowing a user to select relevant track features as waypoints), periodically, in response to a pull request, and/or with any other suitable frequency/timing. Automatically generated waypoints can be determined in locations along the track based on system rules and track constraints (i.e., where a vehicle is able to stop). For example, waypoints can be generated in proximity to track features based on track rules, regulatory constraints, and/or system limitations/constraints. A single waypoint can be automatically generated for a track feature (e.g., at a milepost or charging station) and/or multiple waypoints can be automatically generated around a track feature (e.g., on either side of a crossing; on each leg of a switch; etc.). In a first example, waypoints can be automatically generated on the reverse, normal, and facing legs of switches (e.g., which are used as destinations to move the vehicle through the switch and as staging locations to park the vehicle before making a move through the switch; at clearance points which are offset by appropriate clearance distances/constraints on each leg, etc.). In a second example, waypoints can be automatically generated around crossings (e.g., at clearance points offset on either side of the crossing by an appropriate clearance; allowing either side of the crossing to be selected in order to move the vehicle through the crossing and as staging locations to stop the vehicle before making a move through the crossing).

However, the system can otherwise generate and/or manage waypoints, and/or the system can include or be used with any other suitable track data system and/or map service(s).

Figure 10:
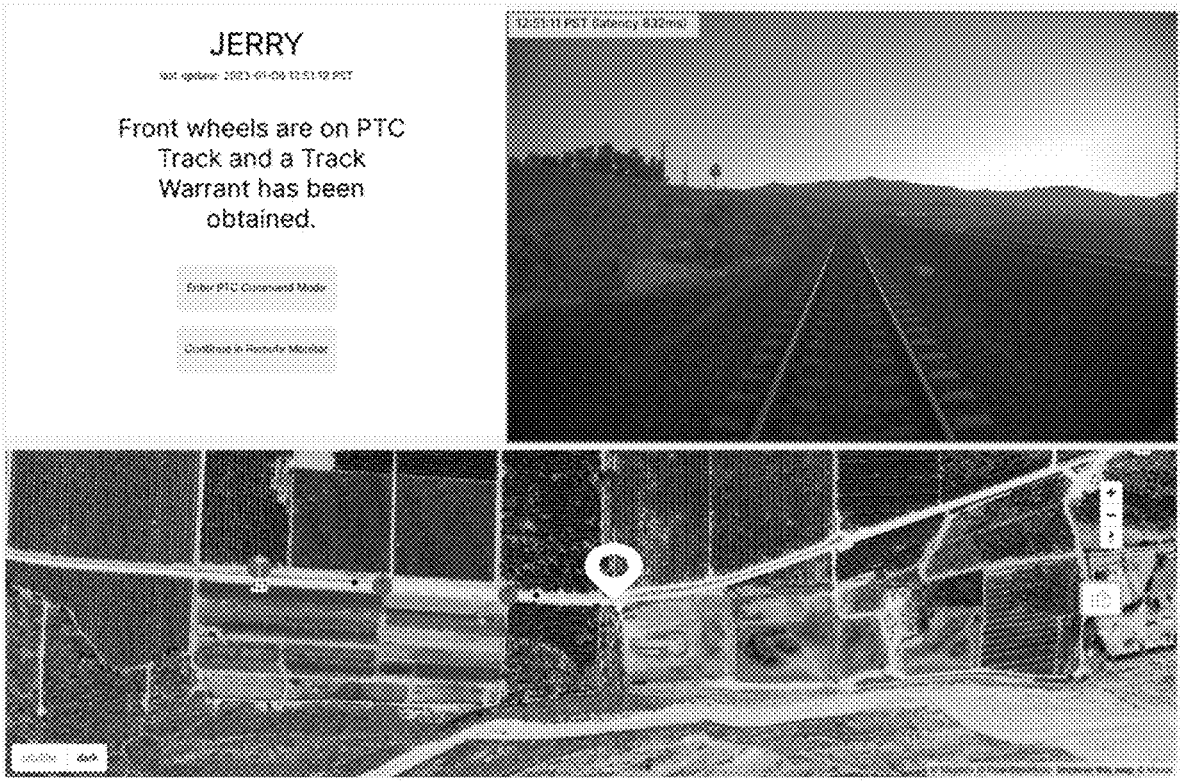
FIG. 10 is an example of a display interface in one or more variants of the remote operator platform.

The track data system can include or operate in conjunction with the switch management system/service. For example, the track data system preferably indexes track coordinates and/or waypoint positions for each switch in the rail network. The switch management service (i.e., layered on top of the track map service, such as in a management hierarchy, an example of which is shown in FIG. 10) can manage the belief state for each switch in the rail network, along with the (current) switch reservations. Accordingly, switch management is preferably indexed globally and/or referenced against the feature waypoints (i.e., semantic waypoints, rather than tied to indices in a particular map version or set of track map coordinates). However, switch management can additionally or alternatively utilize track coordinates/indices associated with a particular map version, and/or can be otherwise managed. Similarly, switch states data and/or switch reservations can be independently managed by the switch management system and/or can be aggregated by the track data system/service and switch data can be pushed to (or pulled by) various endpoints in the system (e.g., in global waypoint coordinates and/or track map geometry).

However, track data can be otherwise suitably managed and/or stored in the system. Additionally or alternatively, databases for track data and/or data resources of the system (e.g., motion plans and/or track reservations managed by the motion planner; switch states and/or switch reservations managed by the switch management system; etc.) can be centralized, distributed, and/or otherwise stored/distributed between system elements. For example, a single database can aggregate: map data (e.g., track map along with track rules/bulletins), switch states, train command and control states (e.g., vehicle state data; vehicle commands and/or motion plans), vehicle routes, external data (e.g., received via an API; such as received from a railroad integration system), and/or any other suitable data (e.g., where individual systems/services manage updates to state data/parameters).

In variants, the system and/or track data system/service thereof can optionally include or be used in conjunction with a railroad integration system/service which functions to translate authority grants from a railroad authority (ies) into a movement authority (a.k.a., macro-warrant) which can be provided to the motion planner (a.k.a., vehicle dispatch system). Additionally or alternatively, the railroad integration system can transform protocol-specific authority grants, issued by a railroad authority, into a unified form (e.g., movement authority). Additionally or alternatively, the railroad integration system can be used to update mapped track data based on information received from the railroad authority (e.g., map updates, track condition updates, track feature updates, bulletin notifications, etc.). For example, map updates received from the railroad integration system and/or railroad authority (e.g., speed restrictions; bulletins; etc.) may be accessed/referenced by the switch management system prior to issuing new switch reservations and/or updating switch states. Additionally or alternatively, map updates may hold reservations for a subset of switches (e.g., with active track bulletins), which may prevent vehicles from being routed through said switches and/or updates to the switch state (e.g., restricting access to switches and/or changes to switch state; such as where switches are under construction/maintenance, for example).

The railroad integration system can receive a set of inputs from the railroad authority, which can include: track signals, authorization forms, track feature updates (i.e., changes to track geometry/features), track condition updates, track bulletins, and/or any other suitable information. The set of inputs is preferably received according to a predetermined protocol, specific to a particular railroad authority, but can be received in any suitable data format. In a specific example, the railroad integration service can include an API (specific to a particular railroad authority; generalized API which can interface with each railroad authority; etc.). Additionally or alternatively, the railroad integration service can be integrated into an API Gateway, can communicate with an API Gateway (e.g., allowing the railroad integration system and/or railroad authority to communicate with the track data system and/or map service such that the data can be accessed by switch management system and motion planner), and/or can be otherwise integrated with and/or interface with various components of the system.

The railroad integration system can determine a movement authority, or a (coarse) authority region of track, based on the inputs from the railroad authority. For example, the movement authority can be defined based on a starting and ending point along the track (e.g., coordinate point, in track map coordinates; relative to track nodes/features/segments, etc.) and can include a set of intervening track sections (e.g., relative to a track map). The inputs can be transformed into movement authorities based on a predetermined set of rules, transformations, and/or protocols (e.g., which can be railroad authority specific or railroad authority agnostic). Movement authorities can be determined as a one-to-one mapping of authority grants from a railroad into a track map reference frame, and/or can be further constrained based on a set of rules/heuristics. For example, movement authorities and/or constraints associated therewith may be used to delineate between 'autonomous' sections of track and 'teleoperation' sections of track (e.g., restricted speed sections, where the authority is only granted under may only under a condition of remote supervision). Similarly, movement authority constraints may establish track rules and/or policies governing switch positions (e.g., default switch position; etc.) and/or switch monitoring/validation (e.g., periodic verification/validation requirements, etc.).

In variants, movement authorities can additionally include a set of operating constraints which can be received from the railroad authority and/or another endpoint (e.g., user interface, fleet management system), and/or can be retrieved from a track data system. For example, the operating constraints can include a speed-constraints (e.g., speed limit), directional constraint (e.g., unidirectional movement constraint, bidirectional movement constraint, etc.), track restrictions (e.g., teleoperation track segments, advisory bulletin restrictions, etc.), time constraints (e.g., expiration parameter associated with the movement authority, etc.), and/or any other suitable operational constraints. The railroad integration system can include processing and/or processing modules which can be: local, remote (e.g., at a remote server, at a third party server, cloud processing, etc.; an element of the remote systems), centralized, distributed, and/or processing for the railroad integration system can be otherwise executed. In variants, movement authorities can be updated by the railroad integration system periodically, aperiodically, in response to receipt of an updated authority grant from a railroad authority, and/or with any other suitable timing/frequency. Additionally or alternatively, movement authorities can be invariant/fixed until completed and/or vacated. In variants, movement authorities can be pushed to the various processing endpoints (e.g., motion planner and/or switch management system), such as in response to movement authority issuance, and/or pulled from data storage (e.g., cloud data service), such by the motion planner and/or switch management system. However, track data can be otherwise suitably determined and/or managed.

In variants, the system and/or data service thereof can optionally include or be used with a set of Application Program Interface (API) Gateways, by which external/user-facing system(s)/components(s) can interface with vehicle dispatch and track data systems/services (e.g., coupling the UI and/or Railroad Service to motion planning, switch management, fleet management, and/or data systems). For example, the API Gateway(s) can handle authorization, Quality of Service (QOS), translation protocols, and/or any other suitable tasks/functionalities. As a second example, the user interface and/or switch management systems can be integrated into the API Gateway and/or can interface with the motion planner via an API Gateway(s). However, the system can be used with any other suitable API(s) and/or without an API Gateway(s) in various contexts.

3.1 Motion Planner

The motion planner (a.k.a., vehicle dispatch system) functions to direct traversal and/or dispatch of a set of vehicles within the rail network. Additionally or alternatively, the motion planner can function to impose motion constraints on vehicles within the rail network (e.g., based on proceed authorization as granted by remote supervision and/or teleoperation instruction; imposing constraints based on track rules/requirements, such as requiring remote monitoring and/or proceed authorization along a segment of track, etc.). Additionally or alternatively, the motion planner functions to determine a set of (exclusive) track reservations which (granularly) direct vehicle operation throughout the rail network and/or implement Positive Train Control (PTC) protections (e.g., along a particular vehicle route). Additionally or alternatively, the motion planner can function to facilitate remote assistance and/or supervised autonomy via the remote operator platform, and/or any other suitable functionalities.

The motion planner determines exclusive reservations (a.k.a., micro-warrants) for each of the set of vehicles and/or vehicle controllers thereof operating within the rail network. In a first example, the motion planner can determine a respective reservation for each train (and/or platoon) within the rail network (e.g., an example is shown in FIG. 10). In a second example, the motion planner can determine a respective reservation for a single vehicle within the rail network, such as a single electric vehicle/bogie as described in U.S. application Ser. No. 17/694,499, filed 14 Mar. 2022, and/or U.S. application Ser. No. 17/335,732, filed 1 Jun. 2021, each of which is incorporated herein in its entirety by this reference. In a third example, the motion planner can provide exclusive reservations to a switch and/or a keep out zone associated therewith (e.g., preventing vehicles/platoons from simultaneously directing/controlling the switch state and/or occupying the switch).

The exclusive reservations can include or be associated with: a (granular) track region (e.g., a subset of the larger warrant issued by a railroad authority which grants movement authority along the track; a subset of a route; a list of track segments referenced to map; track boundary constraints; a track segment including switch and/or surrounding keep out zone, such as between a set of clearance points; etc.), a set of operational parameters (e.g., target speed, speed limit, traversal direction), an expiration parameter (e.g., duration of proceed authority; such as based on roundtrip latency for a particular data frame), a track condition parameter (e.g., checksum, validation parameter, etc.), a set of heartbeat parameters/signals, switch position data (e.g., from the switch management system), and/or any other suitable parameters/information. For example, an exclusive reservation can include a (granular) track region corresponding to a switch and a set of adjacent track segments (e.g., between a set of clearance points, within a threshold distance of the switch, such as within 10 meters, 100 meters, etc.; within a switch keep out zone, etc.).

In some variants, the exclusive reservations can include or be associated with a heartbeat parameter (or heartbeat mechanism/signal). For example, the reservations itself and/or a command associated therewith, may serve as a heartbeat mechanism where the vehicle and/or a vehicle controller thereof is limited in its ability to autonomously/independently proceed by the (granular) authority grant/command associated with the exclusive reservation. Thus, the vehicle may require receipt of periodic heartbeat signals (i.e., commands) in order to continue smoothly, without stopping. For instance, in the event of a communication failure and/or divergence in a track condition checksum for a reservation (e.g., n+1 reservation issued to a particular vehicle), the vehicle may be limited by the constraints of a prior (e.g., n) reservation and/or command. In absence of communication between the motion planner and the vehicle controller (e.g., at time n+1, n+2, etc.), the motion planner may rely on the prior (e.g., n) reservation and/or constraints thereof to maintain granular awareness of the location of the vehicle (e.g., which may facilitate persistent collision avoidance throughout the rail network and/or granular state estimation for the purpose to fleet management, switch state management, and/or vehicle command generation). Alternatively, the reservations can include or be used in conjunction with a separate heartbeat parameter/signal, which may be issued with the same timing/frequency as the reservations or a different timing/frequency.

The motion planner can issue exclusive reservations and/or provide exclusive reservations to vehicles (e.g., via wireless communication, such as an LTE connection): periodically, aperiodically, in response to a change in switch state (e.g., of an adjacent switch), in response to a track map update (e.g., change in track condition, issued bulletin, track geometry change, state change, etc.), in response to a warrant update from a railroad authority (e.g., based on and/or with any other suitable timing/frequency), in response to receipt of an updated vehicle state (e.g., from the vehicle controller), and/or with any other suitable timing/frequency. More preferably, the motion planner can issue exclusive reservations with at least a predetermined minimum frequency (e.g., corresponding to a heartbeat parameter/signal). For example, the exclusive reservations can function as a heartbeat signal and can be issued periodically (e.g., every 10 seconds, every 20 seconds, etc.).

Exclusive reservations can include a (granular) region of track (e.g., defined in a track coordinate frame for a particular map version) and/or operational parameters which can be determined based on vehicle commands which direct vehicle routing and/or traversal within the rail network. Vehicle commands can be predetermined (e.g., for a train running a fixed schedule), received from a fleet management system, manually determined by a human operator (e.g., commanding vehicle operation within a rail yard; operation requests determined via a user interface or API), and/or otherwise determined. Commands can be assigned/directed to a particular vehicle and/or a vehicle identifier associated with a vehicle controller of the vehicle. For example, a command can be associated with a navigation and traversal of a train between an initial location and a destination. Alternatively, vehicle commands can be unassigned, undirected, vehicle indiscriminate, and/or can be any other suitable commands.

In variants, the motion planner automatically determine exclusive reservations based on: the vehicle routing instructions (e.g., routing commands received from a fleet management system, a user interface, a tele-operation platform, etc.), extant macro-warrant(s) (e.g., received from the railroad integration system), the vehicle state (e.g., received from the vehicle controller to which the exclusive reservation will be granted/assigned), track conditions (e.g., received/retrieved track map data), the reservation update frequency, other vehicles' states, platoon parameters (e.g., number of vehicles in a platoon, platoon weight, etc.), UI inputs, remote operator inputs (e.g., at a teleoperator platform), and/or any other suitable information. In a first example, the track region of a reservation can be automatically determined contemporaneously and/or synchronously with (autonomous) operation/control of the respective vehicle (e.g., by the vehicle controller) to facilitate continuous and/or unencumbered operation of the respective vehicle under nominal conditions (e.g., absent emergent scenarios, absent proximal changes to track conditions, etc.). For instance, the motion planner can sequentially determine exclusive reservations spanning adjacent portions of track which collectively grant the vehicle authority to maintain a substantially continuous speed (e.g., 30 mph) while traversing a track region which exceeds the bounds of an initial reservation of the sequence. The exclusive reservation can be: calculated, looked up, determined using a set of heuristics, predicted (e.g., using a trained neural network), predetermined, randomly determined, manually determined, and/ or otherwise determined. The exclusive reservations generated from the same warrant can have the same or different parameters (e.g., track region, duration, velocity permissions, switch state requirements, etc.).

In some variants, the motion planner can determine/grant a single exclusive reservation within a warrant or a plurality of exclusive reservations per warrant (e.g., which may facilitate platoon formation, such as described in U.S. application Ser. No. 17/732,143, filed 28 Apr. 2022, which is incorporated herein in its entirety by this reference). Exclusive reservations grants can be maintained indefinitely (e.g., while the vehicle occupies the corresponding region of track), can expire based on an expiration condition (e.g., in response to a determination of a superseding/replacement reservation at a subsequent time, in response to satisfaction of an expiration condition associated with an expiration parameter, in response to vehicle egress from the corresponding track region, etc.), and/or can be otherwise managed. In a first example, an exclusive reservation can be superseded by a subsequent reservation associated with the same vehicle (e.g., vehicle controller and/or vehicle identifier). Alternatively, exclusive reservations can remain active/valid until a vehicle vacates the reserved (exclusive) region of track (e.g., confirms operation under a subsequent reservation and/or communicates a release the reservation and/or reserved region of track) and/or can be otherwise released/managed.

The motion planner preferably maintains exactly one active/valid reservation per vehicle, but can additionally or alternatively issue two active/valid reservations per vehicle (e.g., wherein the vehicle operates under exactly one reservation; wherein the $n^{th}$ reservation is superseded by the n+1th reservation in response to a subsequent heartbeat confirmation, but both remain valid in absence of the heartbeat signal to accommodate asynchronous operation of the vehicle and motion planner), a plurality of reservations per vehicle (e.g., each corresponding to a respective expiration parameter), and/or any other suitable number of exclusive reservations per vehicle and/or vehicle controller. In one example, an exclusive reservation can be issued to the lead vehicle at a forward end of a platoon. In a second example, an exclusive reservation can be communicated to a plurality of vehicle controllers within a platoon (e.g., at a lead vehicle of each car, each vehicle controller, etc.; where each vehicle controller is individually constrained to operate within the reserved region of track). In a third example, reservations can be issued for the collective of vehicles within a platoon, but can additionally or alternatively be issued independently for each of a plurality of vehicles within the platoon (e.g., where each vehicle is individually limited by tighter constraints on the reservation, such as based on a relative position along the length of the platoon). However, (exclusive) reservations can be otherwise suitably granted and/or managed.

The motion planner can include processing and/or processing modules which can be: local, remote (e.g., at a remote server, at a third party server, cloud processing, etc.), centralized (e.g., centralized for a particular geographic region and/or region of rail network), distributed, and/or processing for the motion planner can be otherwise executed. In a specific example, motion planning can be regional and/or a set of regional motion planners can each govern reservation issuance over a respective track region. In variants, the motion planner and the set of vehicles (and/or vehicle controllers thereof) within the network preferably operate contemporaneously and/or synchronously, where the motion planner can issue exclusive reservations asynchronously to individual vehicles of the set (e.g., facilitating asynchronous state management of the vehicles within the network).

However, the motion planner(s) and/or vehicle dispatch systems can otherwise facilitate motion planning, vehicle dispatch, and/or vehicle routing.

3.2 Vehicle

The system can include or be used in conjunction with a set of vehicles which functions to collect perception inputs and execute vehicle commands. Additionally, vehicles can function to traverse within a rail network and/or within a remotely monitored (e.g., speed restricted) segment thereof. Each vehicle can include a sensor suite, a vehicle controller, and/or any other suitable elements. The sensor suite functions to collect sensor data (e.g., localization, imaging, etc.), with which the vehicle controller can estimate the vehicle state and determine vehicle control (e.g., based on commands issued by a motion planner and/or proceed authority from a remote operator). The vehicle(s) and/or vehicle controllers thereof can generate vehicle data, which can include sensor data (e.g., RGB image stream; point cloud; perception data; etc.), vehicle state data (e.g., vehicle trajectory, internal diagnostics, track position estimate, etc.), environmental representations (e.g., object detections, classifications, and/or tracking data; rail geometry estimates; annotated perception data; etc.), and/or any other suitable vehicle data. However, the vehicle can include any other suitable elements and/or can be otherwise configured. Additionally or alternatively, the system and/or operator platform thereof can be configured to facilitate operation of a remote vehicle and/or can be used with any other suitable vehicle(s). For example, the vehicle(s) can be as described in one or more of: U.S. application Ser. No. 17/694,499, filed 14 Mar. 2022, titled "ELECTRIC RAIL VEHICLE," U.S. application Ser. No. 17/335,732, filed 1 Jun. 2021, titled "ELECTRIC RAIL VEHICLE," each of which is incorporated herein in its entirety by this reference.

The sensor suite functions to monitor vehicle state parameters which can be used for vehicle control (e.g., autonomous vehicle control). The sensor suite can include: internal sensors (e.g., force sensors, accelerometers, gyroscopes, IMU, INS, temperature, voltage/current sensors, etc.), external antennas (e.g., GPS, cellular, Bluetooth, Wi-Fi, Near Field Communication, etc.), rail sensors (e.g., wheel encoders, cameras, temperature sensors, voltage/current sensors, accelerometers, etc.), payload sensors (e.g., force sensors/switches, cameras, lights, accelerometers, NFC sensors, etc.), environmental sensors (e.g., cameras, temperature, wind speed/direction, accelerometers), guidance sensors (e.g., load cells, bumper contact switches, strain sensors, lights, horn, sonar, lidar, radar, cameras, etc.), and/or any other suitable sensors. The sensors can include one or more: Radar sensors, LIDAR sensors, sonar sensors, cameras, spatial sensors, location sensors, force sensors, on-board diagnostic sensors such as vehicle mechanism sensors, audio sensors, barometers, light sensors, temperature sensors, current sensors, air flow meters, voltmeters, contact sensors, proximity sensors, vibration sensors, ultrasound sensors, electrical sensors, and/or any other suitable sensors. However, the electric vehicle can include any other suitable sensors.

The sensor suite preferably includes a set camera(s) at a fixed position (e.g., height) relative to the track. For example, the vehicle can include at least one forward facing camera which can provide a video feed for remote monitoring and/or proceed authorization. Additionally, the vehicle can include a rearward facing camera (e.g., which can be used to facilitate reversal and/or operation in an opposing direction), and/or can provide any other suitable sensor data to a remote monitor (e.g., speed, object detection/tracking annotations, etc.). As an example, teleoperators may toggle between video feeds of multiple cameras on a vehicle and/or in a platoon; and/or multiple video feeds may be viewed simultaneously/contemporaneously in some variants (e.g., forward camera along with side cameras, for instance).

In some variants of the system operating in a rail setting, sensors/cameras with a fixed mounting position and/or predefined field of view (FOV) may have a predefined range of horizon lines. For example, where the maximum grade of a railroad track is 3%, the horizon line as viewed by a camera fixed to a rail vehicle may be substantially static (e.g., in terms of pixel coordinates/height; with a height variance of less than 3%, several hundred pixels, etc.; an example horizon is illustrated in FIG. 6). However, the camera height can be variable (e.g., based on suspension characteristics, etc.), and/or sensors can be otherwise suitably mounted/arranged relative to the vehicle.

However, the vehicle can include any other suitable set of sensors.

Each vehicle controller functions to control a vehicle within the rail network to facilitate operation of the vehicle based on the vehicle commands (e.g., issued by the motion planner) and/or dispatch instructions derived therefrom. More preferably, the vehicle controller functions to facilitate autonomous operation of the vehicle within a reservation (and/or reserved region of track associated therewith), based on the constraints of the reservation and/or the operational parameters of the reservation. For instance, the vehicle controller can facilitate autonomous operation of the vehicle within the track region using the versioned track geometry (e.g., for a waypoint-based route/motion plan). As an example, the vehicle controller may retain agency to stop within the track region based on perceived surroundings or internal diagnostics, but the movement/control of the vehicle controller may be directed and/or limited by the dispatch instructions (e.g., and/or static/dynamic constraints associated therewith; such as an authority region, speed constraints, logic gates, etc.). The vehicle commands may constrain: maximum speed, maximum proceed distance (e.g., movement boundaries), autonomy level (e.g., full autonomy, partial autonomy, human-in-the-loop control, etc.), direction of operation (e.g., unidirectional operation, bidirectional operation, etc.), proceed capability through a track feature (e.g., teleoperation and/or manual validation/verification may be required to advance through a switch of unknown state, for example), period of command validity (e.g., where the vehicle must stop in absence of a currently valid command), and/or can otherwise constrain vehicle operation.

Additionally, prior to executing the commands/instructions, the vehicle controller can validate the commands/instructions received from the motion planner (such as the track geometry or belief state for track features pertaining to the instruction; autonomous validation of a switch state). In a first example, commands and/or track-geometry-referenced coordinates thereof can be validated using a version identifier for the track map (e.g., stored locally at the vehicle in association with current track geometry version and/or received in association with a command; prior to execution), such as by way of a checksum or other validation protocol (e.g., hash function, etc.). In a second example, a belief state for a track feature associated with a command (e.g., target switch state) can be autonomously validated (e.g., by local vehicle perception, onboard the vehicle) before the vehicle proceeds across the switch; wherein the autonomous vehicle (and/or a tele-operator with granting proceed authority, such as through a speed restricted region) can retain agency to stop the vehicle before crossing a switch.

In variants, the vehicle controller can facilitate remote vehicle operation and/or remote validation of vehicle operations by any one or more of the systems and/or methods described in U.S. application Ser. No. 18/514,946, filed 20 Nov. 2023, titled "SYSTEM AND/OR METHOD FOR REMOTE OPERATION OF A RAIL VEHICLE," which is incorporated herein in its entirety by this reference. In a first example, the vehicle controller can facilitate remote (teleop) determination/validation of a switch state. In a second example, the vehicle controller can facilitate remote supervision of vehicle operation (e.g., through a speed restricted track region; as may be required under various track rules) and/or remote proceed authorization (e.g., based on a vehicle camera and/or video feed) to move across a switch. In such variants, the vehicles can wirelessly broadcast vehicle data to a cloud data system e.g. via WebRTC, RTSP, HLS), which can create an endpoint accessible to remote infrastructure (e.g., a user interface and/or a tele-operation platform). Remote data systems/servers may allow operators to toggle between vehicle data streams in real time (or near real time) via the UI. Additionally, vehicles can transmit (locally stored) vehicle data to remote infrastructure via any other suitable data connections (e.g., LTE data connection, Wi-Fi, etc.), which may allow larger data volumes to be offloaded/stored when a high bandwidth connection exists, which can enable subsequent (asynchronous) analysis or supervised model training based on larger data volumes. Data (e.g., video streams, commands, etc.) can be transferred using any suitable data transfer protocol(s), such as WebRTC, LL-HLS, combination thereof, and/or any other suitable data transfer protocol(s). As an example, a Media Service backend deployed on a CDN may facilitate communication between the vehicle, motion planner, and/or UI such that the remote systems do not directly communicate with the vehicle (e.g., and/or video feed). For example, an intermediary behind the RTC application may facilitate high-bandwidth, multi-stream routing (e.g., particularly as the number of vehicles, video streams, and UI endpoints is scaled), selectively forwarding data and/or video streams (e.g., from vehicles to the UI endpoints) as desired. Similarly, the UI may be communicatively decoupled from the vehicle, and instead indirectly control the vehicle via the motion planner (e.g., which may further limit proceed authorization based on extant track reservations, track rules, etc.; which may periodically broadcast motion planning updates and/or commands to the vehicle [s] and verify communication integrity). However, the vehicle can be otherwise suitably communicatively connected via any wireless network(s).

In variants, the vehicle controller can facilitate vehicle control and/or platooning in accordance with the system and/or methods as described in U.S. application Ser. No. 17/732,143, filed 28 Apr. 2022, which is incorporated herein in its entirety by this reference. In a specific example, the vehicle controller can be the controller of a leading vehicle of a leading car of a platoon (e.g., wherein a remainder of vehicles and/or cars of the platoon are controlled based on the operation of the leading car).

The vehicle controller preferably determines a vehicle state (a.k.a., vehicle status) and communicates the vehicle state to the motion planner (e.g., which can be used for validation, verification, and/or subsequent reservation determination [s]). The vehicle state determined by the vehicle controller can include: speed estimation, battery characteristics (e.g., state of charge, state of health, state of power, etc.), heading, diagnostic parameters (e.g., battery characteristics, powertrain characteristics, sensor characteristics, etc.), perception performance (e.g., heading distance, etc.), brake performance estimates (e.g., max stopping distance), environmental representations (e.g., classification of objects/obstacles in the environment), and/or any other suitable vehicle state parameters/estimates.

Additionally, the vehicle controller can provide loop closure communicating (to the motion planner and/or data services) confirmation of updates to reservation assignment (e.g., confirming operation under an n+1 reservation), switch position (e.g., loop closure on belief state of a switch), track map updates (e.g., track condition parameter; via checksum), heartbeat parameters (e.g., central system connection parameters, warrant update parameters, etc.), and/or any other suitable information. In variants, if either the vehicle controller or the motion planner is unable to (asynchronously) validate communications and/or coordination relative to the track, the vehicle controller can control the vehicle to stop within the reservation.

In a first example, if the vehicle controller and/or motion planner detects that the vehicle has moved along the wrong track segment at a switch and/or otherwise detects an error in the belief of a switch state (e.g., CV-based detection, motion-based detection, etc.) and/or vehicle position, the vehicle remains constrained to stop within the existing reservation and no other vehicles will be able to traverse through the switch and/or reserved track segment(s) until the error is resolved and/or the reservation is released. In a second example, if the vehicle controller does not receive a heartbeat signal and/or an updated reservation (e.g., in the case of a communication failure, for example), the vehicle controller can stop the vehicle within the reserved region of track. Similarly, if the motion planner is unable to validate the communications from the vehicle controller, the system can directly control the vehicle to stop (e.g., via wireless communications) and/or indirectly control the vehicle to stop (e.g., restricting the vehicle by not issuing a superseding reservation which may be required for the vehicle to proceed).

Additionally or alternatively, the vehicle controller can function to distribute power and/or communications onboard the vehicle to affect vehicle control. The vehicle controller can additionally or alternatively function to implement autonomous navigation commands, teleoperation commands (e.g., received from a remote teleoperator), autonomous vehicle control (e.g., based on the set of operational parameters), and/or any other vehicle control. The controller is preferably onboard the vehicle (e.g., mounted to a vehicle chassis, etc.), but can alternatively be remote from the vehicle. The controller can be centralized (e.g., packaged within a single module) or distributed (e.g., across multiple compute nodes, packaged within multiple compute modules, etc.). The controller can receive sensory inputs/measurements from the sensor suite, which can be used to determine a vehicle state, dynamically control the vehicle, manage the batteries, and/or control the electric powertrain. The controller can include a battery management system which functions to monitor the state of the battery. The state of the battery can include: state of charge (SoC), state of health (SoH), state of power (SoP), state of safety (SoS), temperature (e.g., of the battery or a set of cells therein, of a working fluid, a temperature distribution of battery cells, etc.), and/or any other suitable characteristics. The battery management system can also function to control the charge and/or discharge of the battery. However, the controller can include any other suitable BMS. The controller can include one or more motor controllers which function to condition power from the battery to be supplied to a motor and/or to control electrical propulsion and/or dynamic (regenerative) braking at the motor. There can be a single motor controller associated with the vehicle, one motor controller per motor, and/or any other suitable number of motor controllers. However, the controller can include any other suitable motor controllers. In variants, the controller can function to facilitate vehicle transit and/or powertrain control as described in U.S. application Ser. No. 17/335,732, filed 1 Jun. 2021, which is incorporated herein in its entirety by this reference. In variants, the controller can control a platoon of electric vehicle(s) individually or may be used to control vehicles in a pairwise manner (e.g., via V2V communications, etc.).

In variants, a vehicle controller can include: a speed controller, velocity controller, PID controller, MPC controller, nonlinear controller, feedback controller, feedforward controller, and/or can implement any other suitable control schemes or any combination/permutation thereof.

However, the system can include any other suitable vehicle controller and/or operate in conjunction with any other suitable vehicle(s) or vehicle control scheme(s).

The vehicle and/or vehicle controller thereof can be configured to transmit vehicle data to the motion planner and/or other external systems (e.g., remote data systems), which can include vehicle state data (e.g., speed or velocity, localization data, sensor data, etc.), sensor data (e.g., camera image frames), timing data (e.g., GPS clock timestamp, etc.), perception data (e.g., annotated image frames; object detection/tracking data, etc.), and/or any other suitable data. Data can be offloaded with any suitable timing/frequency (e.g., event driven, periodically, based on operational mode, based on the track rules, etc.) and/or data format(s). In one set of variants, the vehicle can emit data and/or media via a WebRTC communication framework (e.g., which can facilitate in-browser web monitoring from a remote operator platform). As an example, each data frame emitted from the vehicle can include metadata such as: a timestamp and/or hashed timestamp (e.g., hashed with a specific vehicle key; timestamp with asymmetric encryption or another form of embedded cryptographic validation), vehicle state data (e.g., GPS location; linearized track position relative to a track map; etc.). However, the vehicle can transmit any other suitable data in any other suitable data format(s).

While operating in a (remote) monitoring mode, the vehicle preferably operates strictly within an authority granted region of track associated with a prior transmitted data frame. In absence of a subsequent/superseding authority grant from the remote operator platform (e.g., associated with a subsequent data frame recorded while moving), the vehicle will stop within the authority granted region until a subsequent command, authority grant, and/or heartbeat signal is received. As an example, the vehicle can remain within a section of track which has been observed/monitored by a human independent of the roundtrip communication latency and/or in the event of communication failure.

As an example, a remote operator may grant proceed authorization and/or facilitate command of the vehicle based on a first image frame, and while the rail vehicle is autonomously controlled based on the set of commands: a second frame of the video stream can be provided to the remote operator, wherein proceed authorization is passively granted to the vehicle based on the provision of the second frame to the remote operator (i.e., tacit remote supervision at the remote operator platform; based on video feed 'heartbeat' mechanism).

However, the system can include or operate in conjunction with any other suitable vehicle(s).

4. Remote Operator Platform

The remote operator platform functions to facilitate remote monitoring and/or command of the vehicle in one or more operational modes.

The remote operator platform can be configured to operate in a monitoring mode, in which a remote (tele-) operator can grant proceed authority to the vehicle to traverse within the line-of-sight of the remote operator, while retaining agency to revoke proceed authority, stop the vehicle, and/or otherwise intervene in response to emergent scenarios. Proceed authority can be granted actively (e.g., manual adjustment of line of sight and/or proceed authorization) and/or passively (e.g., supervision of video feed). Proceed authority is preferably associated with individual image frames (e.g., received from the vehicle, with some inherent latency) and granted as a distance relative to the position of the vehicle associated with the image frame. The distance can be defined relative to the track and/or a predetermined map thereof (e.g., stored track map; position and/or distance relative to a linearized segment of track), a GPS coordinate position, and/or any other suitable positional reference(s). Additionally or alternatively, the proceed authority grant can be associated with a (motion relative) time-constraint, such as the minimum time required for the vehicle to traverse the authorized distance along the track while operating based on a speed constraint (e.g., authorized speed; speed limit for the track region; etc.). Proceed authority can be passively granted (e.g., based on a stable position of an adjustable line of sight; based on an input position of a slider, scroll wheel, or other input mechanism), but can additionally or alternatively be granted based on a continuous/periodic input from an input device (i.e., position of a slider; click to proceed; etc.), and/or other suitable input.

Figure 12:
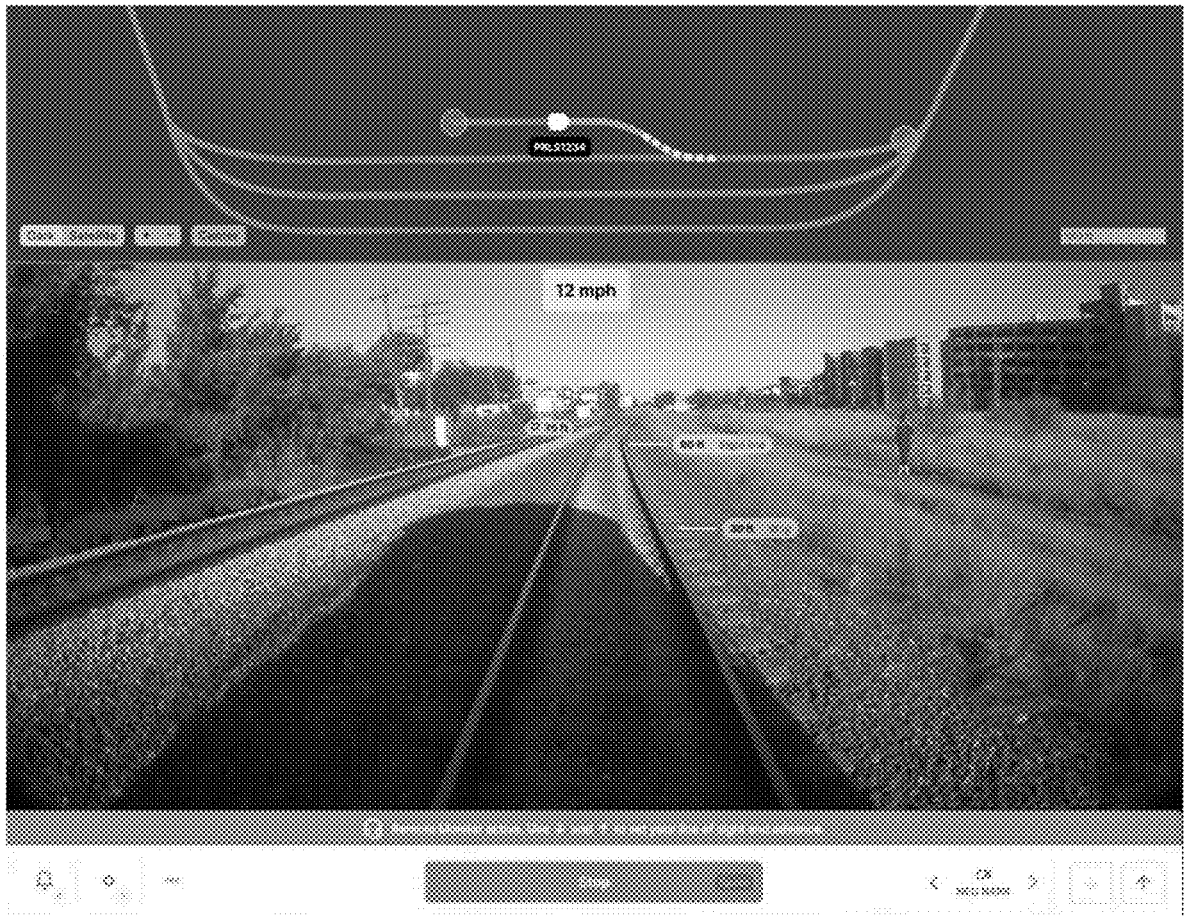
FIG. 12 is an example of a display interface in one or more variants of the remote operator platform.

In the monitoring mode, proceed authority is preferably granted based on the visibility and/or line of sight of the remote operator monitoring the incoming data frames. The remote operator preferably maintains and/or adjusts a line-of-sight indicator for incoming image frames (e.g., in real-time) at the remote operator platform. For example, the line-of-sight indicator can be an arrow overlayed with the track (e.g., an example is shown in FIG. 6; where the length of the arrow is adjustable), a line/boundary (e.g., an example is shown in FIG. 5; a second example is shown in FIG. 12; straight or curved), and/or any other suitable indicator. For instance, the remote operator can adjust the line-of-sight in an augmented image overlay and/or relative to track map coordinates along a track map (e.g., alongside route waypoints, control points, speed restriction boundaries, switch positions, track authority boundaries, etc.). However, the line-of-sight can be otherwise suitably adjusted and/or displayed to a remote operator.

The line-of-sight indicator is preferably placed in the virtual scene overlaid on the image by an augmented reality (AR) display mechanism, allowing adjustments by the operator and/or constraints on the track, but can be otherwise suitably indicated in association with the image frame(s) and/or can be otherwise suitably provided. The adjustments to the indicator are preferably manual, but can additionally be constrained based on the ambient lighting conditions, time-of-day, vehicle state (e.g., speed), track data (e.g., accessed from a remote data system; periodically, in real time, for each incoming data frame, etc.), track rules, operating rules/restrictions, motion planner rules/constraints (e.g., where the motion planner may stop the vehicle and/or restrict operation of the vehicle as it approaches a misaligned switch/junction, etc.), and/or otherwise adjusted/modified. Proceed authorization can then be automatically granted for individual data/image frames based on the line-of-sight indicator provided for the frame. Accordingly, the line-of-sight may automatically direct the proceed authorization and corresponding stopping distance (e.g., in absence of intervening communication), which can additionally be displayed (e.g., overlayed with a stopping distance and/or proceed authorization indicator; examples are shown in FIG. 4 and FIG. 5).

In a first variant, the line-of-sight indicator can be mapped to a distance based on the pixel coordinates of the indicator (e.g., pixel height, for a straight track, tip of arrow, etc.) such as using a lookup table (e.g., predetermined based on the horizon line and/or mounting position of the camera; based on the visual horizon reference). In a second variant, the line-of-sight indicator can be used to estimate the visibility down the track based on a set of predetermined rules or heuristics. In a third variant, the line-of-sight indicator can be used to estimate the visibility relative to the pixel width of the track. In a fourth variant, the line-of-sight distance can be estimated using a pinhole projection model. However, line-of-sight distance can be otherwise determined for each image frame.

In the monitoring mode, proceed authorization is preferably granted within the line-of-sight according to a predetermined set of rules/heuristics. For example, proceed authorization can be half the line-of-sight distance (e.g., where stopping within half line-of-sight may be a general operational constraint of the vehicle). Additionally, proceed authorization may optionally be adjusted/reduced to factor in communication latency and/or a reaction time 'buffer' (e.g., building in time for a remote operator to react to distant objects within line of sight and/or changing conditions down the track). For example, the authorized distance may be automatically reduced by a static/dynamic offset (e.g., latency multiplied by the vehicle speed, yielding the maximum distance that the vehicle may traverse between transmission of a data frame and the corresponding command/authorization).

Proceed authorization is preferably granted within a command and/or heartbeat signal (e.g., with the same periodicity of frame transmission; preferably in real time or substantially real time) and/or can be granted separately from motion planner commands (e.g., high-level 'point to point' instructions, etc.). For example, proceed authority can be substantially periodic (e.g., with the same transmission frequency as the video feed), but can alternatively be aperiodic (e.g., based on manual inputs, dependent on attention monitoring trigger events, etc.), and/or can be provided with any other suitable frequency/timing.

Additionally, along with proceed authorization, the remote operator can command and/or constrain vehicle speed. For example, the remote operator can directly select/adjust the speed using a dedicated input mechanism (e.g., a throttle). Alternatively, the remote operator can indirectly adjust the vehicle speed based on the visibility, wherein the vehicle speed may be reduced based on the latency and distance of proceed authorization (i.e., stopping distance). Further constraints can be predefined, such as the maximum roundtrip latency which the system may tolerate before commanding the vehicle to stop and/or the maximum vehicle speed within a speed restricted track region (e.g., 20 miles per hour; which may be governed by track rules and/or operating rules of the railroad, such as GCOR).

In a first set of variants, the remote operator platform can include a computing system, a display, a set of input devices, and/or any other suitable hardware components. The computing system functions to enable the communication and data processing to facilitate remote monitoring and/or tele-operation by way of the set of input devices and display. The remote operator platform and/or computing system thereof are preferably remote (relative to the vehicle), and can be communicatively coupled to the vehicle and/or motion planner via any suitable communication channels and/or protocols. For example, the remote operator platform can be coupled to the vehicle via an API, and communicatively coupled to the motion planner (e.g., by a separate API, integrated within a remote computing system/network, etc.). However, the remote operator platform can include any other suitable hardware/infrastructure components and/or can otherwise interface with any other suitable hardware devices (e.g., authorized user device/tablet executing a Web application, etc.).

However, the remote operator platform can be otherwise configured.

Figure 7:
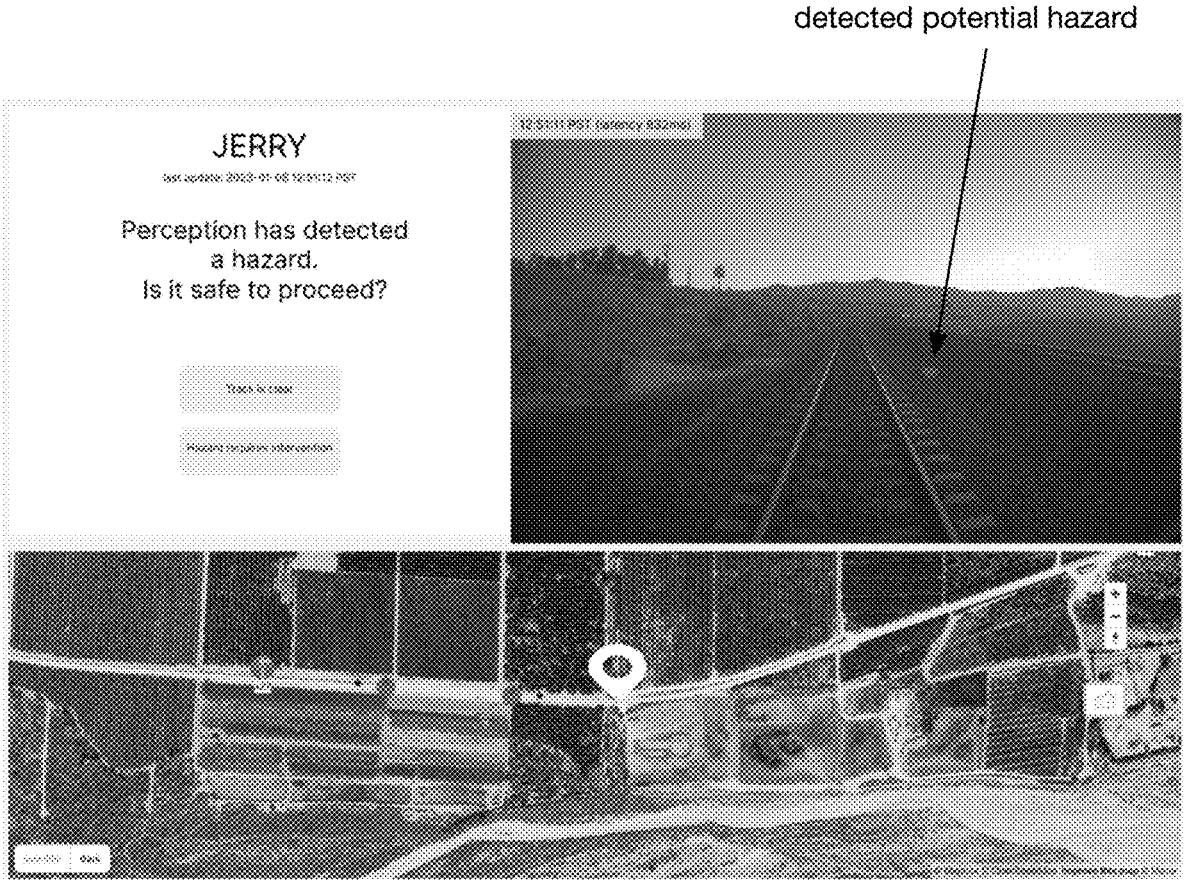
FIG. 7 is an example of a display interface in one or more variants of the remote operator platform.

The set of input devices function to facilitate command verification (e.g., actively, passively), user adjustment of a line-of-sight indicator, and/or command determination (e.g., issuance of a proceed command to move past a potential hazard, an example of which is illustrated in FIG. 7; issuance of a 'STOP' command; etc.). The set of input devices can be wired, wireless, separate from the display (e.g., keyboard mouse, joystick, inceptor, etc.), integrated with a touch-screen display, and/or can be otherwise implemented. In a specific example, the set of input devices can include a low-latency, wired mouse (e.g., performance gaming mouse; high sensitivity/DPI; <1 ms input lag). The set of input devices can include binary input mechanisms (e.g., push buttons, point-and-click, etc.; emergency stop button), analog inputs (e.g., scroll wheels, sliders, etc.; which may facilitate highly/infinitely variable continuum of inputs), touchscreen inputs, and/or any other suitable input mechanisms. However, the remote operator platform can include any other suitable input devices.

The remote operator platform can include a display, which functions to display image frames (and/or a real-time video feed; an example is shown in FIG. 6) from the vehicle to a remote user/tele-operator, which can be used to facilitate vehicle monitoring and/or command validation. Additionally, the remote operator platform (and/or display thereof) can continuously and/or selectively display frame metadata (e.g., communication latency [ies], data timestamp, etc.), vehicle state data (e.g., speed, battery state of charge, location relative to a track map, obstacle detection/tracking data, etc.), command information (e.g., proceed authorization relative to track map; track-relative position and/or GPS location of vehicle; target destination; etc.), and/or any other suitable parameters.

Additionally, the display preferably provides an image overlay indicating a line-of-sight visualization (such as an arrow, line indicator, etc.) and/or stopping distance (e.g., proceed authorization) visualization. The line-of-sight distance is preferably user adjustable (e.g., with the input devices and/or input mechanisms thereof, such as a scroll wheel, slider, etc.), which the user may actively adjust based on their real-time observations of incoming image frames, wherein the proceed authorization (and/or stopping distance associated therewith) is automatically determined at the remote operator platform based on the line-of-sight distance. For example, the proceed authorization may be based on both line-of-sight distance and the vehicle kinematics/dynamics, such that the vehicle retains the ability to stop within some fraction of the line-of-sight (e.g., less than half of the line of sight distance)

Figure 11A:
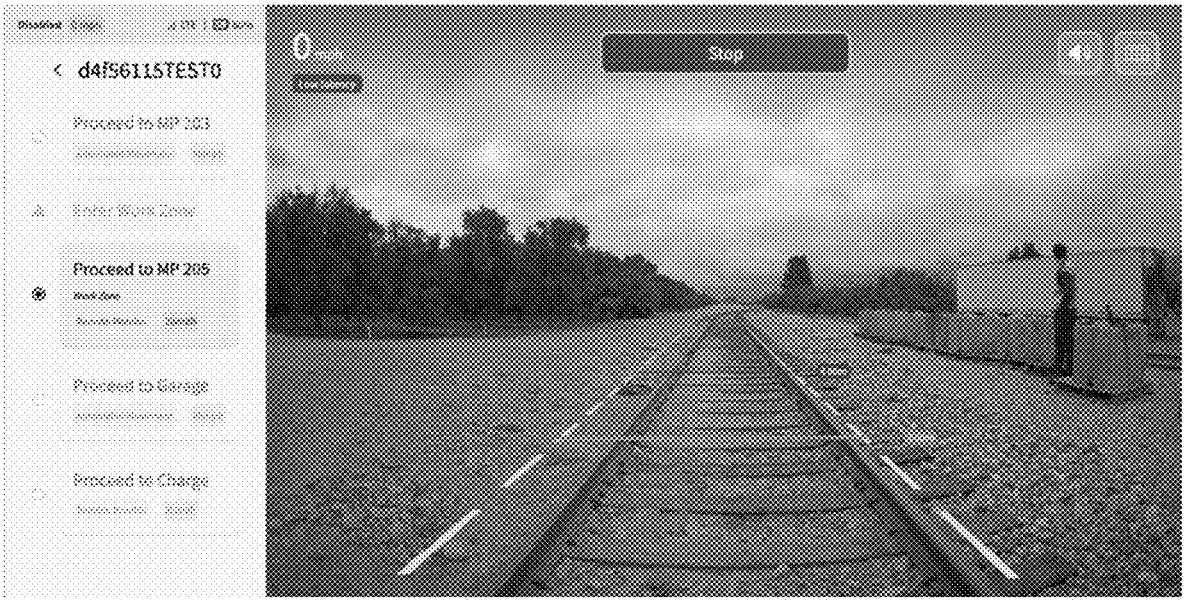
FIGS. 11A-11B are a first and second example of a remote monitor overlay implementation in one variant of the remote operator platform and/or display interface thereof.
Figure 11B:
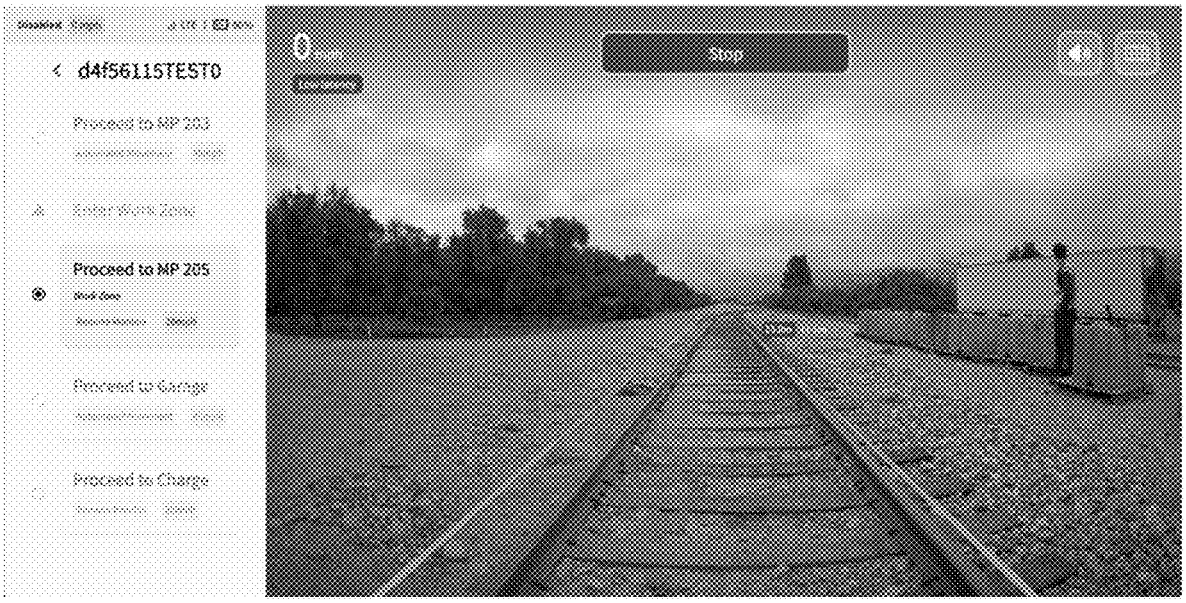

In one set of variants, the system (e.g., remote operator platform) can use geospatial track data to render an AR-style overlay of track features and movement indicators (e.g., an example is shown in FIGS. 11A-11B).

In an illustrative example (e an example is shown in FIGS. 11A-11B), dashed lines can represent the intended vehicle path in an AR-style overlay, which transition to solid lines (along the sides of the track) once the user has indicated the vehicle can proceed that distance down the track. A first line segment may represent the user's (confirmed) line of sight. The second line segment represents the distance the vehicle will actually travel (½ the line of sight) once the user confirms the movement target. The lines alongside the track can be represented in a data format similar to that representing the track map and the vehicle's current reservation/warrant (e.g., GeoJson, geocsv, etc.). The remote operator platform frontend can utilize geospatial calculations to render the visual indicators for the line of sight and travel distance at real latitude and longitude points, calculated in relation to the front of the vehicle, which may be used to authorize movement over the (real) sections of track. The overlay can be rendered to the screen/display using a 3D rendering library which receives the geospatial coordinates and projects them on the screen (e.g., with a first-person perspective). To improve accuracy with the video screen, the projection matrix and extrinsic matrix representing the mounting pose relative to a fixed position on the vehicle can be configured to represent a perspective with the same position and parameters as the vehicle's camera(s). The GPS position of the vehicle can be included in each video frame streamed to the UI, keeping the position in sync.

The display can optionally indicate and/or otherwise enable adjustments to a visual horizon reference (e.g., pre-calibrated based on the mounting position of the camera relative to the vehicle). The visual horizon reference can be static/invariant, pre-calibrated for the camera/vehicle (e.g., based on the mounting position of the camera), predetermined, dynamically determined/adjusted, manually adjustable, and/or otherwise defined. For example, the visual horizon reference can be defined at a pre-calibrated pixel height for the camera, but can additionally be manually adjustable by a user. As an illustrative example, the visual horizon can be used as a reference to estimate distances associated with user monitoring/validation (e.g., distance estimation as a function of pixel coordinates relative to the horizon; where observable distances can be defined/estimated relative to the horizon reference). Additionally or alternatively, distance along the track can be estimated relative to the track width at a particular pixel height (e.g., where the width between rails is a known constant for a particular rail vehicle), and/or can be otherwise suitably defined. Additionally or alternatively, the visual horizon reference may limit the maximum line-of-sight distance a user may select (e.g., it may not be feasible for a user to verify a lack of hazards and/or grant proceed authority within a band of the pixels approaching the horizon line, which may be many miles away; where pixels adjacent to the horizon line, in absence of terrain features, may correspond to the limit approaching infinite distance in the visual field). Accordingly, the user may be restricted from selecting pixels within a predetermined pixel band of the visual horizon, and/or the line-of-sight may be otherwise constrained.

Additionally or alternatively, in some variants, a visual horizon reference may not be required and/or may not be utilized. Instead, the track data, vehicle GPS position, and physical location of the cameras on the vehicle can be used to calculate the pixel coordinates of visual indicators for the video overlay.

However, the system can be otherwise configured.

The remote operator platform can optionally include an attention monitoring system and/or functionality. For instance, user inattentiveness may preclude a user from observing some hazards (particularly distant hazards which are still within the line-of-sight), and thus attention monitoring systems and/or protocols may be used to verify user attention, particularly in cases where there are very long delays between adjustments of the line-of-sight (e.g., which may regularly occur along straight segments of flat track, an example of which is shown in FIG. 6). In a first variant, user inputs (e.g., via various input mechanisms, such as the scroll wheel, can be used to verify attentiveness). In a second variant, user responses (e.g., via one or more input mechanisms) to periodic prompts/queries can be used to validate user attentiveness. In a third variant, eye tracking devices can be used to validate user attentiveness. User attentiveness can be verified/monitored periodically (e.g., every 15 seconds, every 30 seconds, etc.), aperiodically (e.g., on an event driven basis), in response to satisfaction of a trigger condition (e.g., 15 seconds since last adjustment of line-of-sight distance; temporal trigger; vehicle state trigger, such as an object detection trigger; eye-tracking trigger, wearables trigger, etc.), and/or with any other suitable frequency/timing. However, the system can include any other suitable attention tracking system(s), and/or can be otherwise suitably implemented.

In one example, user interactions can include: pressing a first key (e.g., W key) which moves the line of sight/travel distance forward along the track; pressing a second (e.g., S key) which moves the line of sight/travel distance backward (e.g., towards the vehicle/user perspective; proximally) along the track; and pressing the a third key (e.g., Enter key) which authorizes the vehicle to proceed to the end of the travel distance. In some implementations, keys cannot be held down to send multiple commands in succession (e.g., the user may be required to complete a discrete keypress each time they wish to issue a command, proceed authorization, and/or change to line of sight).

In variants, the set of input devices can include redundant power and/or data connections, and/or may continuously/periodically monitor connection integrity. For example, the remote operator platform can optionally include interlocks devices and/or hardware validation systems/functionalities which can validate that the user input mechanism(s) are operational (i.e., that a user monitoring the vehicle is able to stop the vehicle or otherwise intervene to appropriately adjust commands to emergent events). However, the input devices can alternatively be redundant, rely on backup (battery) power sources, and/or can be otherwise configured.

Figure 8:
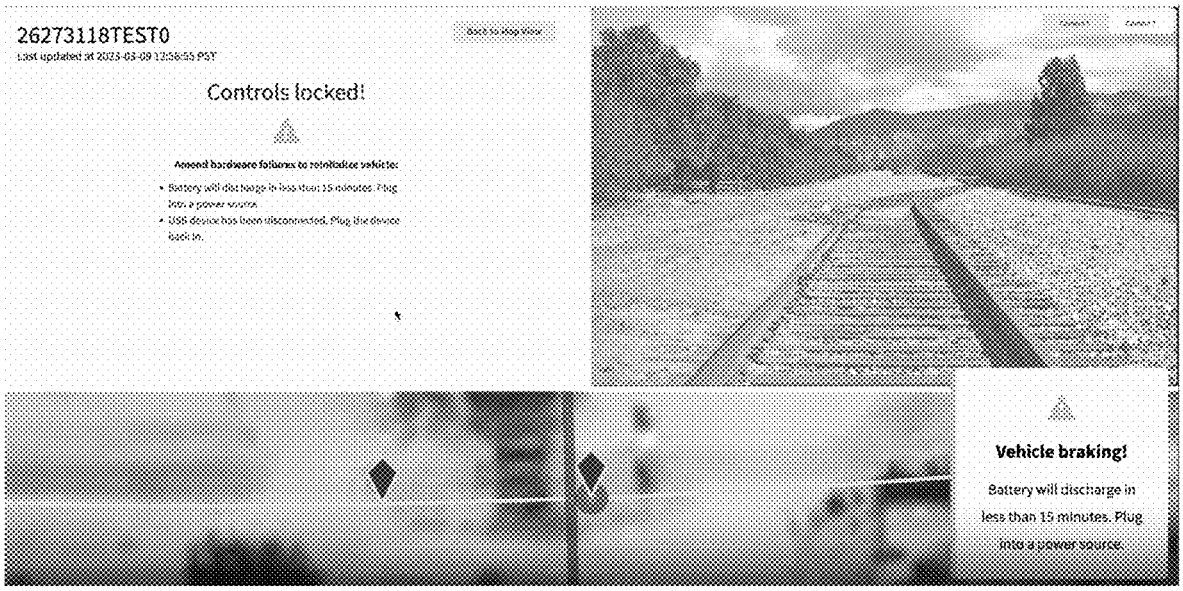
FIG. 8 is an example of a display interface in one or more variants of the remote operator platform.

In one example, the tele-operator controls may be locked in response to a determination of a hardware failure (e.g., detected at the remote operator platform; an example is illustrated in FIG. 8), and the remote operator platform can automatically issue a stop command (and/or passively restrict future proceed authorization until control functionality is restored).

However, the remote operator platform can otherwise facilitate remote vehicle monitoring and/or can be otherwise suitably implemented.

Figure 9:
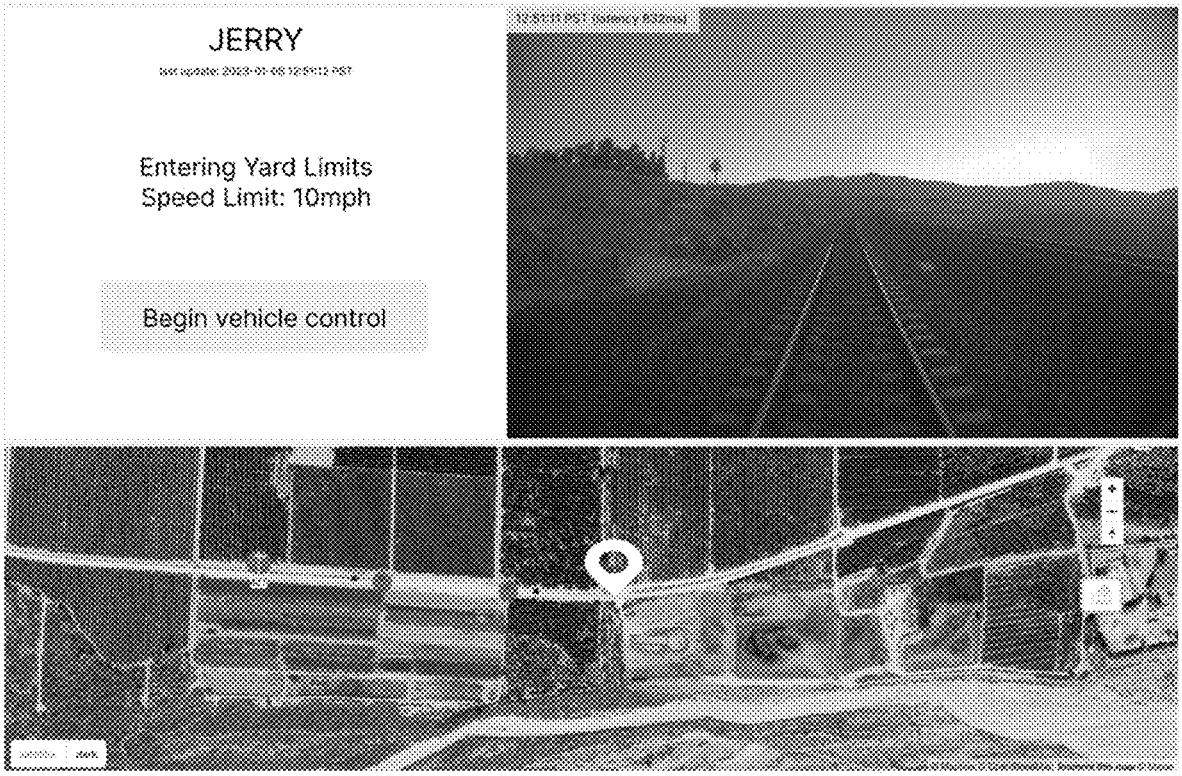
FIG. 9 is an example of a display interface in one or more variants of the remote operator platform.

In variants, remote operator intervention via the remote operator platform is preferably requested (e.g., push request; an example is shown in FIG. 9) by the vehicle and/or motion planner based on the location of the vehicle (i.e., track rules for the current location of the vehicle) and/or vehicle state (e.g., detected potential hazard) in response to satisfaction of a trigger condition or event. For instance, the remote operator may monitor the vehicle as is proceeds through a speed restricted region of track (e.g., an example is shown in FIG. 9), and/or may monitor the vehicle as it traverses past a potential hazard (e.g., an example is shown in FIG. 7). The remote operator may retain command authority until the vehicle has exited a speed restricted region and/or until the remote operator releases command authority. For example, the remote operator platform may facilitate transitions from a remote monitor operation mode to an unmonitored PTC mode (e.g., fully autonomous) in response to an input from a remote operator via the set of input devices (e.g., an example is shown in FIG. 10).

As a first example, remote operator intervention can be requested and/or queued as described in U.S. application Ser. No. 18/514,946, filed 20 Nov. 2023, which is incorporated herein in its entirety by this reference.

As a second example, when the vehicle departs a speed restricted region of track (e.g., based on track coordinate position), the remote monitoring system can manually (e.g., based on an input from the remote operator) or automatically release control authority to the motion planner, returning the system to waypoint-based control and existing the remote monitoring mode.

However, the system can be otherwise suitably configured and/or can include any other suitable elements.

5. EXAMPLE METHOD

In variants (e.g., an example is shown in FIG. 3), the system can facilitate execution of a method including: collecting sensor data with a sensor suite of an autonomous vehicle; monitoring a media stream from the autonomous vehicle; determining a line-of-sight for each image frame of the media stream; determining a command based on the line-of-sight (e.g., adjusting control limits associated with a command based on the media stream); and autonomously controlling the vehicle based on the commands and the sensor data.

In variants, a method comprises: autonomously controlling a rail vehicle; contemporaneously with autonomously controlling the rail vehicle, determining a request for a remote operator; and responding to the request, comprising: providing a set of vehicle data to the remote operator, the vehicle data comprising a video stream from the rail vehicle, each frame of the video stream tagged with a respective timestamp; based a set of inputs received from the remote operator, determining a first distance for a first frame of the video stream; determining a second distance for the first frame based on the first distance; based on the second distance and the respective timestamp of the first frame, providing a set of commands to the rail vehicle; and based on the set of commands, autonomously controlling the rail vehicle.

In a second set of variants, a method comprises: at a remote assistance platform, receiving a set of data comprising a video stream from an autonomous rail vehicle, each frame of the video stream tagged in association with a respective timestamp and a respective position of the autonomous rail vehicle; at a display of the remote assistance platform, displaying the video stream with an overlay comprising a line-of-sight indicator; contemporaneously with displaying the video stream, receiving a set of inputs which adjust the line-of-sight indicator; based on the set of inputs, determining a proceed authorization distance relative to the respective position of the autonomous rail vehicle which is associated with a first frame of the video stream; and commanding the autonomous rail vehicle based on the proceed authorization distance and the respective timestamp of the first video frame.

Alternative embodiments implement the above methods and/or processing modules in non-transitory computer-readable media, storing computer-readable instructions. The instructions can be executed by computer-executable components integrated with the computer-readable medium and/or processing system. The computer-readable medium may include any suitable computer readable media such as RAMs, ROMs, flash memory, EEPROMs, optical devices (CD or DVD), hard drives, floppy drives, non-transitory computer readable media, or any suitable device. The computer-executable component can include a computing system and/or processing system (e.g., including one or more collocated or distributed, remote or local processors) connected to the non-transitory computer-readable medium, such as CPUs, GPUs, TPUS, microprocessors, or ASICs, but the instructions can alternatively or additionally be executed by any suitable dedicated hardware device.

Embodiments of the system and/or method can include every combination and permutation of the various system components and the various method processes, wherein one or more instances of the method and/or processes described herein can be performed asynchronously (e.g., sequentially), concurrently (e.g., in parallel), or in any other suitable order by and/or using one or more instances of the systems, elements, and/or entities described herein.

As a person skilled in the art will recognize from the previous detailed description and from the figures and claims, modifications and changes can be made to the preferred embodiments of the invention without departing from the scope of this invention defined in the following claims.

We claim:

1. A method comprising:

autonomously controlling a rail vehicle;

contemporaneously with autonomously controlling the rail vehicle, determining a request for a remote operator; and responding to the request, comprising:

providing a set of vehicle data to the remote operator, the vehicle data comprising a video stream from the rail vehicle, each frame of the video stream tagged with a respective timestamp;

based a set of inputs received from the remote operator, determining a first distance for a first frame of the video stream;

determining a second distance for the first frame based on the first distance;

based on the second distance and the respective timestamp of the first frame, providing a set of commands to the rail vehicle; and based on the set of commands, autonomously controlling the rail vehicle.

2. The method of claim 1, further comprising: while autonomously controlling the rail vehicle based on the set of commands:

providing a second frame of the video stream to the remote operator, a first indicator and a second indicator overlayed with the second frame based on the first and second distances, respectively; and passively granting remote proceed authorization to the vehicle based on the provision of the second frame.

3. The method of claim 2, where at least one of the first and second indicators are determined with a pinhole camera projection model.

4. The method of claim 3, wherein the first and second indicators are determined relative to a fixed track width.

5. The method of claim 2, further comprising: providing a response signal based on provision of the second frame of the video stream, the response signal associated with the respective timestamp of the second frame, wherein a time difference between the respective timestamps of the first and second frames is less than a maximum roundtrip latency requirement of the rail vehicle, wherein the vehicle is configured to automatically halt in absence of receipt of the response signal satisfying the maximum roundtrip latency requirement for the second frame.

6. The method of claim 1, wherein the first distance comprises a line-of-sight distance along the track in the first frame.

7. The method of claim 6, wherein the second distance comprises a proceed authorization distance which is, at most, half of the line-of-sight distance.

8. The method of claim 7, wherein the autonomously control of the vehicle based on the set of commands is restricted based on the proceed authorization distance.

9. The method of claim 1, wherein the remote operation request is determined based on a motion plan and a set of track rules, wherein autonomously controlling the rail vehicle based on the set of commands comprises controlling the rail vehicle within a restricted speed track region.

10. The method of claim 1, wherein the video stream comprises a timestamped WebRTC stream.

11. The method of claim 1, further comprising: based on the vehicle data, automatically determining satisfaction of the request and, subsequently, autonomously controlling the rail vehicle based on a set of waypoints.

12. The method of claim 1, wherein, contemporaneously with autonomously controlling the rail vehicle based on the set of commands, motion of the rail vehicle along the second distance is remotely supervised by the remote operator at a teleoperation platform based on the vehicle data.

13. The method of claim 12, further comprising: based on a second input from the remote operator during remote supervision, commanding the rail vehicle to stop.

* * * * *